US007720415B2

(12) United States Patent
Murano

(10) Patent No.: US 7,720,415 B2
(45) Date of Patent: May 18, 2010

(54) IMAGE FORMING APPARATUS INCLUDING FIXING UNIT, AND FIXING UNIT SUPPORT METHOD AND FIXING UNIT POSITION ADJUSTMENT METHOD THEREFOR

(75) Inventor: Junichi Murano, Sayama (JP)

(73) Assignee: Ricoh Company, Ltd., Tokyo (JP)

( * ) Notice: Subject to any disclaimer, the term of this patent is extended or adjusted under 35 U.S.C. 154(b) by 257 days.

(21) Appl. No.: 12/078,144

(22) Filed: Mar. 27, 2008

(65) Prior Publication Data

US 2008/0240781 A1 Oct. 2, 2008

(30) Foreign Application Priority Data

Mar. 28, 2007 (JP) ..... 2007-084767

(51) Int. Cl.
*G03G 15/00* (2006.01)
*G03G 15/16* (2006.01)

(52) U.S. Cl. ..... 399/126; 399/110; 399/122

(58) Field of Classification Search ..... 399/110, 399/122, 126, 107, 111
See application file for complete search history.

(56) References Cited

U.S. PATENT DOCUMENTS

| | | | | |
|---|---|---|---|---|
| 5,594,539 | A | 1/1997 | Murano et al. | |
| 6,725,991 | B2 | 4/2004 | Murano et al. | |
| 6,768,887 | B2 * | 7/2004 | Mikita et al. | 399/122 |
| 6,779,975 | B2 | 8/2004 | Takashima et al. | |
| 6,990,303 | B2 * | 1/2006 | Suzuki | 399/122 |
| 7,106,990 | B2 | 9/2006 | Murano et al. | |
| 7,164,878 | B2 * | 1/2007 | Yamanaka | 399/122 |
| 7,222,471 | B2 | 5/2007 | Matsumoto et al. | |
| 7,386,254 | B2 * | 6/2008 | Okoshi | 399/111 X |
| 2003/0047407 | A1 | 3/2003 | Murano et al. | |
| 2003/0053908 | A1 | 3/2003 | Takashima et al. | |
| 2004/0182048 | A1 | 9/2004 | Matsumoto et al. | |

(Continued)

FOREIGN PATENT DOCUMENTS

JP 2000-318888 11/2000

(Continued)

OTHER PUBLICATIONS

Abstract of JP 2004-013167 published on Jan. 15, 2004.
Abstract of JP 08-171248 published on Jul. 2, 1996.

*Primary Examiner*—Sandra L Brase
(74) *Attorney, Agent, or Firm*—Harness, Dickey & Pierce, P.L.C.

(57) ABSTRACT

An image forming apparatus and methods of supporting and adjusting a position of a fixing unit thereof. The apparatus includes a frame having a first side plate and a second side plate opposing the first side plate, a first unit holding member engaged with the first side plate by a combination of a guide groove and a guide protrusion, a second unit holding member attached to the second side plate, a detachable unit located between the first and second side plates and held by the first and second unit holding members, and a position adjustment member to move the first unit holding member in a longitudinal direction of the guide groove to adjust a position of the detachable unit. The position adjustment member engages the first unit holding member at a position vertically aligned with a center of gravity G of the detachable unit.

12 Claims, 21 Drawing Sheets

U.S. PATENT DOCUMENTS

| | | | | |
|---|---|---|---|---|
| 2005/0095032 | A1 | 5/2005 | Murano et al. | |
| 2006/0210305 | A1 | 9/2006 | Murano et al. | |
| 2006/0226046 | A1 | 10/2006 | Matsumoto et al. | |
| 2007/0002122 | A1 | 1/2007 | Murano et al. | |
| 2007/0059036 | A1 * | 3/2007 | Yamada et al. ..... | 399/122 X |
| 2007/0160383 | A1 | 7/2007 | Matsumoto et al. | |

FOREIGN PATENT DOCUMENTS

| | | |
|---|---|---|
| JP | 3161289 | 2/2001 |
| JP | 2006-258998 | 9/2006 |
| JP | 3902577 | 1/2007 |
| JP | 2007-079319 | 3/2007 |

* cited by examiner

IMAGE FORMING APPARATUS INCLUDING FIXING UNIT, AND FIXING UNIT SUPPORT METHOD AND FIXING UNIT POSITION ADJUSTMENT METHOD THEREFOR

CROSS-REFERENCE TO RELATED APPLICATION

This patent specification is based on and claims priority from Japanese Patent Application No. 2007-084767, filed on Mar. 28, 2007 in the Japan Patent Office, the entire contents of which are hereby incorporated by reference herein.

BACKGROUND

1. Field of the Invention

The present invention relates to an image forming apparatus including a fixing unit, and a fixing unit support method and a fixing unit position adjustment method for the image forming apparatus.

2. Description of the Related Art

In an electrophotographic image forming apparatus, an image is formed on a recording medium such as a sheet of paper or an OHP (overhead projector) film by charging a drum-like or belt-like rotating photosensitive element; irradiating the photosensitive element with light to form a latent electrostatic image thereon; attaching toner to the latent electrostatic image with a development device to make the latent electrostatic image visible as a toner image; transferring the toner image to the recording medium directly or indirectly via a belt-like intermediate transfer unit; and fixing the toner image on the recording medium.

Such an image forming apparatus includes a frame for reinforcing a body of the image forming apparatus against distortion or twisting. The frame is generally made of steel plate and includes a base member, a pair of opposing side plates set up on the base member, and stays or brackets laid between the side plates. In the frame, detachably attachable components such as a photosensitive device, a charging device, an optical writing device, a development device, a transfer device, a fixing device, an intermediate transfer device, and a recording medium feed device are usually provided in the form of a modular unit or a process cartridge including such units.

The fixing device, which is typically unitized for ease of maintenance, generally fixes an image on a recording medium when the recording medium passes through a fixing nip formed by a fixing member and a pressure member. The fixing nip is set parallel to the transfer rollers, etc., in recording medium feeders and transferring devices that transfer a recording medium to each transfer point and fixing point. When and if the fixing nip is angled with the transfer roller, etc., the transfer directions of a recording medium at the fixing nip and the transfer roller, etc., do not match, resulting in skewing of the recording medium and production of abnormal images transformed in a trapezoidal manner, etc.

As a method of preventing such skewing, pursuing component parts tolerances to perfection is practically difficult in light of cost increase as well as from a technical point of view. Furthermore, since there are a number of parts in an image forming apparatus, the tolerances of individual parts such as a fixing unit and a recording medium feeder are cumulative and directly affect the relative positions of these devices, easily displacing them from their parallel positions. In addition, there are part or unit assembly errors to be considered which are difficult to eliminate completely.

In addition, an assembly jig is required for assembling an image forming apparatus, and naturally, highly accurate design and manufacturing are demanded therefor. However, even with such a highly accurate jig, there is a limit to improvement in the accuracy with which devices are positioned parallel to each other.

Although the situation is as described above, to meet current demand for high definition quality images it is desired that an image forming apparatus has recording medium transfer devices, including a fixing unit; that are positioned parallel to each other with a high degree of precision.

SUMMARY

This patent specification describes a novel image forming apparatus that includes a frame having a first side plate and a second side plate opposing the first side plate; a first unit holding member engaged with the first side plate by a combination of a guide groove and a guide protrusion; a second unit holding member attached to the second side plate; a detachable unit located between the first side plate and the second side plate and held by the first unit holding member and the second unit holding member; and a position adjustment member to move the first unit holding member in a longitudinal direction of the guide groove to adjust a position of the detachable unit, the position adjustment member engaging the first unit holding member at a position vertically aligned with a center of gravity G of the detachable unit.

This patent specification further describes a novel fixing unit support method for supporting a fixing unit in an image forming apparatus, including engaging a unit holding member to hold a fixing unit with a frame of a main unit of the image forming apparatus by a combination of a guide groove and a guide protrusion, and providing a position adjustment member having an eccentric cam including a rotary center shaft portion rotatably engaging the frame and an eccentric rotary shaft portion eccentrically positioned relative to the rotary center shaft portion and rotatably engaging the unit holding member at a position vertically aligned with a center of gravity G of the fixing unit.

This patent specification further describes a novel fixing unit position adjustment method for an image forming apparatus, the image forming apparatus including a frame; a unit holding member engaged with the frame by a combination of a guide groove and a guide protrusion to hold a fixing unit; and a position adjustment member having an eccentric cam including a rotary center shaft portion rotatably engaging the frame and an eccentric rotary shaft portion eccentrically positioned relative to the rotary center shaft portion and rotatably engaging the unit holding member at a position vertically aligned with a center of gravity G of the fixing unit, the fixing unit position adjustment method for the image forming apparatus including rotating the position adjustment member and moving the unit holding member in the longitudinal direction of the guide groove to adjust a position of the fixing unit.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
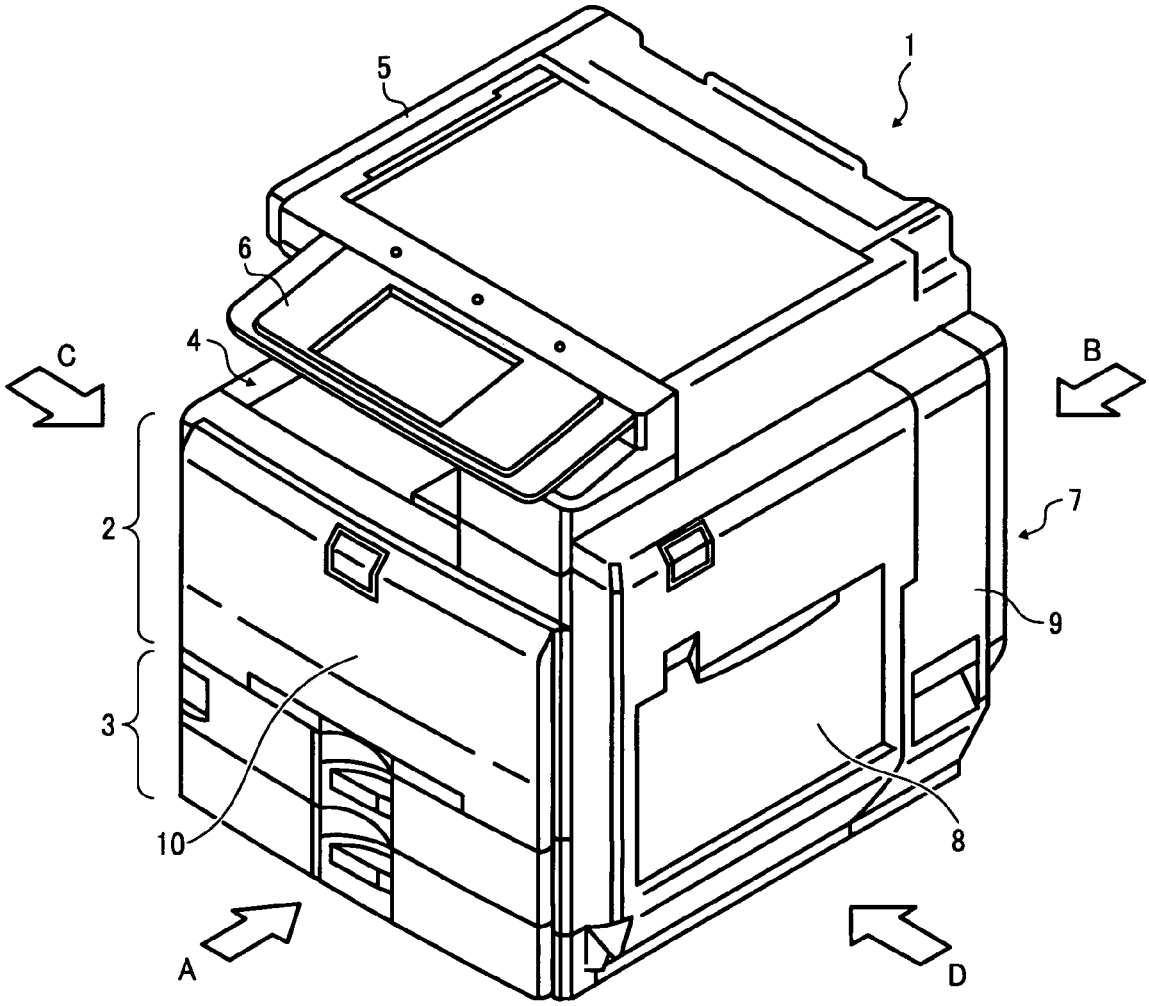
FIG. 1 is an external view illustrating a color copier as an example electrophotographic image forming apparatus according to embodiments of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Figure 10:
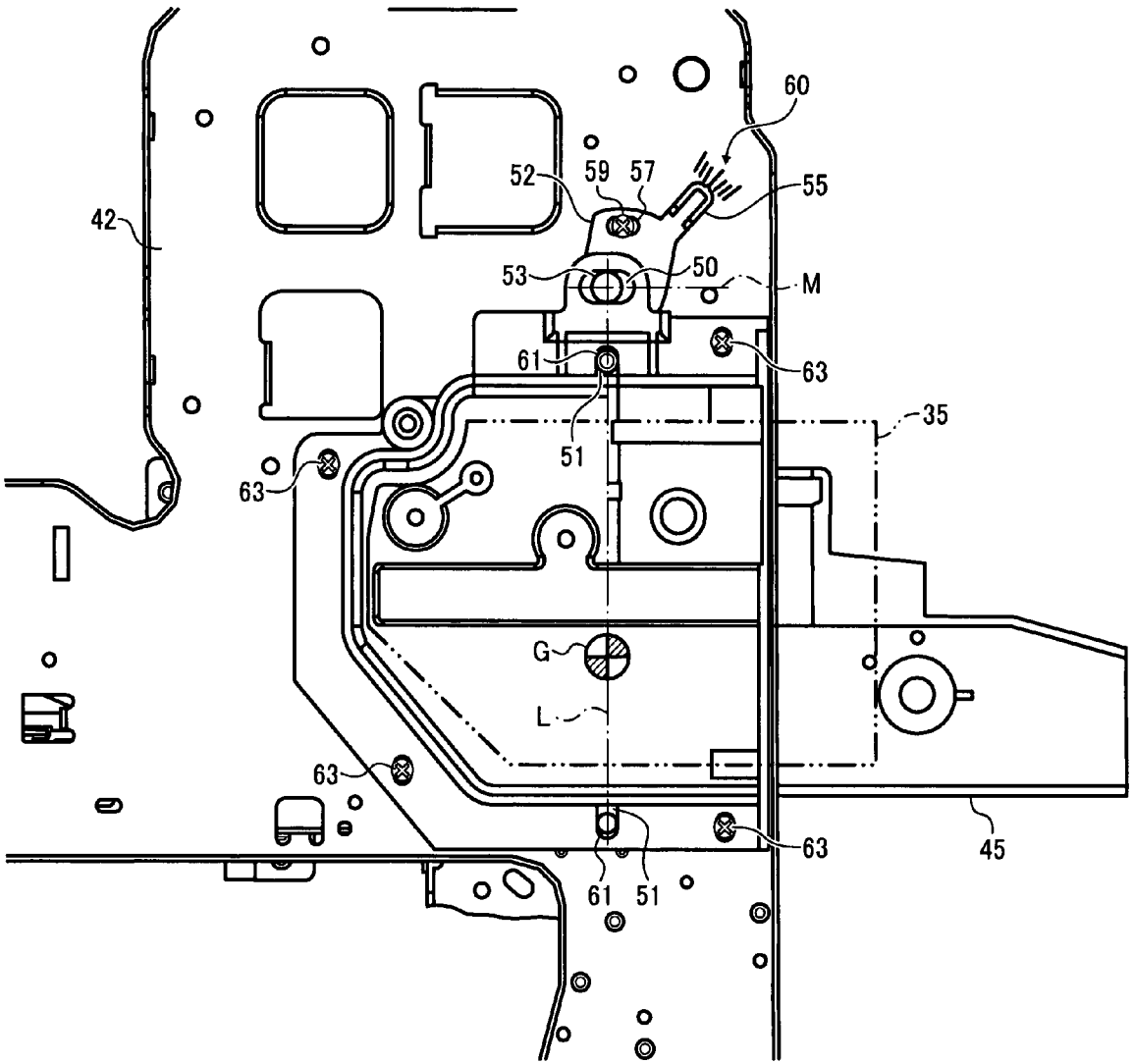
FIG. 10 is a view illustrating the fixing unit according to the first embodiment supported by first and second side plates of the frame via the front and rear holding members.

Referring now to the drawings, wherein like reference numerals and reference characters designate identical or corresponding parts throughout the several views thereof, particularly to FIG. 10, image forming apparatuses according to exemplary embodiments of the present invention are described.

FIG. 1 is an external view illustrating a color copier as an example electrophotographic image forming apparatus according to embodiments of the present invention. It should be noted that the color copier also functions as a printer, a scanner, or a facsimile by establishing a LAN (local area network) cable connection or a telephone line connection.

A main unit 1 of the color copier, which is the main unit of the image forming apparatus, includes a face cover and a frame 40 covered therewith. The frame 40 serves as the frame of the main unit 1. In the main unit 1, an image forming unit 2 that forms and transfers an image to a recording medium is located in the central part of the main unit 1 and a recording medium storage unit 3 that stores and sequentially feeds recording media to the image forming unit 2 is located below the image forming unit 2. The main unit 1 also includes an internal discharge unit 4 that outputs a recorded recording medium, an image reading unit 5 that reads the image of an original, an operating unit 6 situated in front (indicated by arrow A) of the image reading unit 5, and a duplex unit 7 that reverses the side of a recording medium and returns the recording medium to the image forming unit 2 for duplex printing.

The operating unit 6 includes an input unit (including various keys such as a start key, a numeric keypad, a function setting key, a reset key, a clear/stop key) to control a plurality of functions of the main unit 1 and a display unit (such as a liquid crystal display panel or a liquid crystal touch panel also functioning as an input unit) that displays various pieces of input information and an apparatus status.

In FIG. 1, arrow A indicates the front of the main unit 1 as described above, which is the operator side, arrow B indicates the rear, arrow C indicates the left side, and arrow D indicates the right side of the main unit 1.

The color copier also includes a manual feed table 8, a side cover 9, and a front cover 10, all of which can be opened with respect to the main unit 1.

Figure 2:
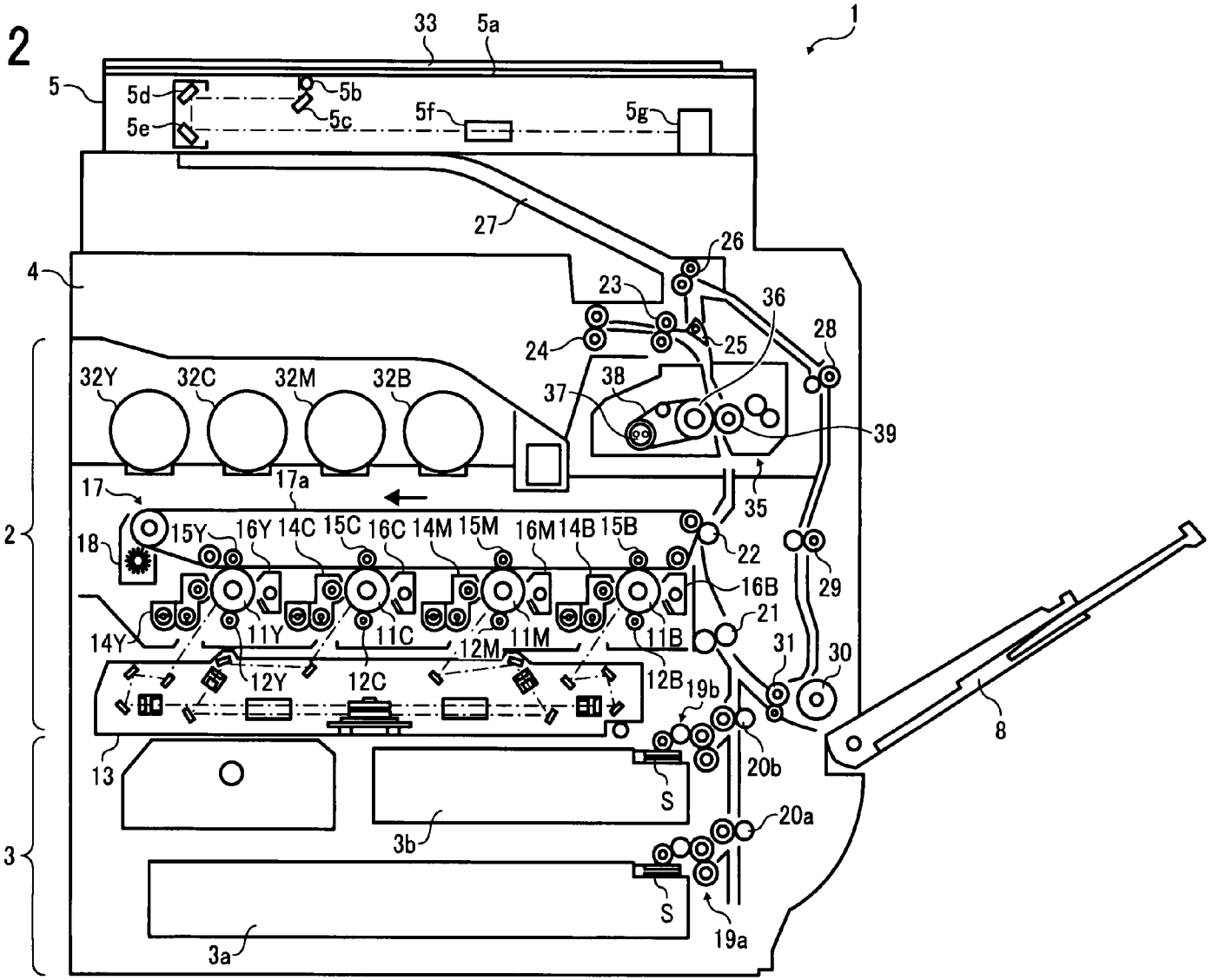
FIG. 2 is a diagram illustrating an inner configuration of the color copier.

FIG. 2 is a diagram illustrating the inner configuration of the color copier of FIG. 1.

The image forming unit 2 includes four image forming stations in a tandem arrangement along an intermediate transfer unit 17 including an endless intermediate transfer belt 17*a*. The four image forming stations form yellow (Y), cyan (C), magenta (M), and black (B) images, respectively. Below the four image forming stations, an optical writing device 13 is located.

The four image forming stations have the same configuration and include photosensitive drums 11Y, 11C, 11M, and 11B serving as image bearing members, around which are located charging devices 12Y, 12C, 12M, and 12B, development devices 14Y, 14C, 14M, and 14B, primary transfer rollers 15Y, 15C, 15M, and 15B, and cleaning devices 16Y, 16C, 16M, and 16B, respectively.

The optical writing device 13 faces the four image forming stations and is formed of four light sources using respective laser diodes (LD) corresponding to the four colors; an optical system that collimates a laser beam emitted from the light sources; a polygon scanner (deflector) that includes a polygon mirror (rotating multifaceted mirror) and a polygon motor; and another optical system including scanning and imaging lenses such as an fθ lens provided on each light path for the light sources, correcting lenses, and mirrors. The laser diodes emit beams of light according to image information of each color and the polygon scanner deflects the beams of light and scans the surfaces of the four photosensitive drums 11Y, 11C, 11M, and 11B with the beams of light to write a latent electrostatic image thereon.

In the image forming unit 2, toner bottles 32Y, 32C, 32M, and 32B are located below the internal discharge unit 4 from left to right in FIG. 2 to supply toner to the development devices 14Y, 14C, 14M, and 14B in the image forming stations. The toner bottles 32Y, 32C, 32M, and 32B are filled with yellow (Y) toner, cyan (C) toner, magenta (M) toner, and black (B) toner, respectively. The toners are supplied from the toner bottles 32Y, 32C, 32M, and 32B to the development devices 14Y, 14C, 14M and 14B in a given amount through conveyance paths, not shown.

The intermediate transfer belt 17*a* in the intermediate transfer unit 17 is supported by a drive roller, a driven roller, etc., and rotates in a direction indicated by an arrow shown in FIG. 2. On the right of the intermediate transfer belt 17*a*, a secondary transfer roller 22 is located. On the left of the intermediate transfer belt 17*a*, an intermediate transfer belt cleaning device 18 is located.

The recording medium storage unit 3, which is situated at the bottom of the main unit 1, includes two paper feed cassettes 3*a* and 3*b* storing a recording medium S. The recording medium S is fed from one of the paper feed cassettes 3*a* and 3*b* by a paper feed device 19*a* or 19*b* and conveyed by a recording medium feeder. Specifically, the recording medium S is fed by conveyance rollers 20*a* and 20*b* to a registration roller 21 and the registration roller 21 feeds the recording medium S at an appropriate timing to a secondary transfer nip formed between the secondary transfer roller 22 and the intermediate transfer belt 17*a*.

According to a first embodiment of the present invention, a fixing unit 35 is located above the secondary transfer roller 22. In the fixing unit 35, a fixing roller 36 and a heat roller 37 support a fixing belt 38 serving as a fixing member. In addition, a pressure roller 39 serving as a pressure member is provided to form a fixing nip with the fixing belt 38.

Above the fixing unit 35, a conveyance roller 23 and a discharge roller 24 that convey and discharge the recording medium S to the internal discharge unit 4, and a switching member 25 that switches the conveyance path for duplex printing are located. Above the conveyance roller 23, the discharge roller 24, and the switching member 25, a reverse roller 26 and a reverse path 27 are located to reverse the conveyance direction of the recording medium S like a switchback. In the case of duplex printing, the recording medium S is temporarily stacked in the reverse path 27 and the conveyance direction thereof is reversed by the reverse roller 26. The recording medium S is then conveyed by conveyance rollers 28 and 29 through a conveyance path for duplex printing and fed to the registration roller 21 again.

The image reading unit 5 is located in the upper part of the main unit 1 and includes a contact glass 5*a* serving as an original table on which an original is placed, an illumination source 5*b* that illuminates the original, a first mirror 5*c* that reflects light reflected from the original, a second mirror 5*d*, a third mirror 5*e*, an imaging lens 5*f* that images the light reflected from the original, and an image sensor 5*g* such as a CCD (charge-coupled device) that is located at an image location and serves as a reading unit for reading the image of the original.

On the image reading unit 5, there is provided a cover 33 that presses the original placed on the contact glass 5*a* against the contact glass 5*a* to keep it in place or an automatic document feeder (ADF) that automatically feeds the original to the contact glass 5*a*.

A description is now given of a copying process executed by the color copier.

The copying process is started by opening the cover 33 (with respect to the main unit 1) and placing an original on the contact glass 5*a* in the image reading unit 5. When the ADF is used instead of the cover 33, the original is placed on the original table of the ADF.

By pressing the start switch of the operating unit 6, the image reading unit 5 is instantly driven when the original is placed on the contact glass 5*a*. When the original is placed on the original table of the ADF, the original reading unit 5 is driven after the original is transferred onto the contact glass 5*a*. Then, a first traveling body including the light source 5*b* and the first mirror 5*c* and a second traveling body including the second mirror 5*d* and the third mirror 5*e* begin to travel. The light emitted from the light source 5*b* is directed to the surface of the original. The first mirror 5*c* in the first traveling body reflects and directs the light reflected from the original to the second traveling body. The second and third mirrors 5*d* and 5*e* in the second traveling body reflect and direct the light through the imaging lens 5*f* to the image sensor 5*g* such as a CCD serving as a reading unit, where the image of the original is read. Then, an image forming operation starts in the full color mode or the monochrome mode. The mode is determined depending on the selection including automatic mode at the operating unit 6.

In the image forming unit 2, the charging devices 12Y, 12C, 12M, and 12B uniformly charge the photosensitive drums 11Y, 11C, 11M, and 11B, which are then irradiated with laser beams emitted from the optical writing device 13 including four laser light sources, the deflector, and the four scanning optical systems to form latent electrostatic images thereon.

The latent electrostatic images are developed by attaching toner of different colors thereto by the four development devices 14Y, 14C, 14M, and 14B so that yellow, cyan, magenta, and black toner images are formed on the photosensitive drums 11Y, 11C, 11M, and 11B.

Subsequently, a primary transfer voltage is applied to the primary transfer rollers 15Y, 15C, 15M, and 15B at different timings, thereby transferring the toner images sequentially to the intermediate transfer belt 17*a* starting from the upstream side and superimposing the toner images one atop another thereon (a process that is herein referred to as primary transfer).

The recording medium S is supplied to the main unit 1 in synchronization with the primary transfer from the recording medium feeder 3*a* or 3*b* in the recording medium storage unit 3 by the recording medium feed device 19*a* and 19*b* or the manual feed table 8 by a recording medium feed roller 30 and a conveyance roller 31. When the leading edge of the recording medium S reaches the registration roller 21, the recording medium S is held there and detected by a sensor, not shown. Then, the registration roller 21 timely feeds the recording medium S to the secondary transfer nip formed between the secondary transfer roller 22 and the intermediate transfer belt 17*a* based on a detection signal generated by the sensor.

The images formed on the intermediate transfer belt 17*a* are conveyed to the secondary transfer nip and transferred to the recording medium S all at one time. The recording medium S is then conveyed to the fixing unit 35 and passes through the fixing nip, where the transferred image is fixed onto the recording medium S by application of heat and pressure. Thereafter, the recording medium S is conveyed by the conveyance roller 23 and discharged by the discharge roller 24 to the internal discharge unit 4. Thus, a color image is formed on the recording medium S.

When the duplex mode is selected at the operating unit 6, the conveyance path of the recording medium S is switched by the switching member 25. The recording medium S of which the image is already fixed on one side is temporarily stacked in the reverse path 27 and the conveyance direction thereof is reversed by the reverse roller 26 like a switchback. The recording medium S is then conveyed by the conveyance rollers 28 and 29 through the conveyance path for duplex printing to the registration roller 21 again in synchronization with the image forming operation.

The registration roller 21 feeds the recording medium S to the secondary transfer nip, where the image formed on the intermediate transfer belt 17*a* is transferred to the back side of the recording medium S. Then, the recording medium S is conveyed to the fixing unit 35 and the transferred image on the back side thereof is fixed onto the recording medium S by application of heat and pressure. The recording medium S is conveyed by the conveyance roller 23 and discharged by the discharge roller 24 to the internal discharge unit 4. Thus, color images are formed on both sides of the recording medium S.

Toner remaining on the photosensitive drums 11Y, 11C, 11M, and 11B is removed by the cleaning devices 16Y, 16C, 16M, and 16B, respectively. Then, the photosensitive drums 11Y, 11C, 11M, and 11B are simultaneously discharged and charged by the charging devices 12Y, 12C, 12M, and 12B to which a direct-current bias overlapped with an alternating-current component is applied to prepare for the next image formation. Toner remaining on the intermediate transfer belt 17*a* is also removed by the intermediate transfer belt cleaning device 18 to prepare for the next image formation.

Figure 3:
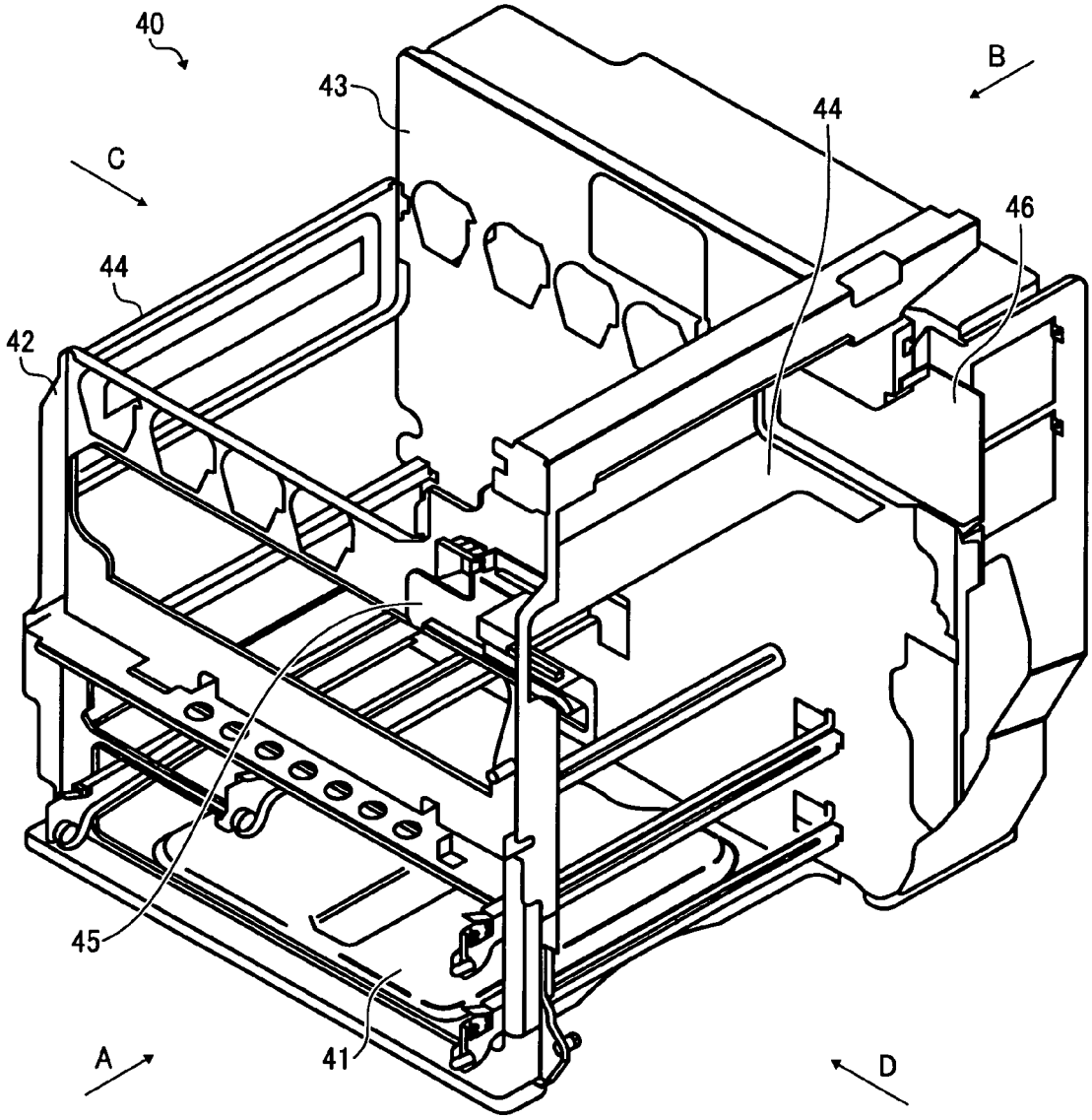
FIG. 3 is a perspective view illustrating a frame of a main unit of the color copier.

FIG. 3 illustrates the frame 40 of the main unit 1.

The frame 40 is made of steel plate and includes a base member 41, opposing first and second side plates 42 and 43 set up on the base member 41, and stays or brackets 44 laid between the first and second side plates 42 and 43. The first side plate 42 is the front side plate provided on the operator side (indicated by arrow A) of the main unit 1. The second side plate 43 is the rear side plate provided opposite to the first side plate 42, from where a driving force is transmitted to, for example, the fixing unit 35.

In the frame 40, there are detachably attached the photosensitive drums 11Y, 11C, 11M, and 11B, the charging devices 12Y, 12M, 12C, and 12B, the optical writing device 13, the development devices 14Y, 14C, 14M, and 14B, the primary transfer rollers 15Y, 15C, 15M, and 15B, the cleaning devices 16Y, 16C, 16M, and 16B, the secondary transfer roller 22, the fixing unit 35, the intermediate transfer unit 17, and the recording medium feed device in the form of a modular unit or a process cartridge including the units.

The fixing unit 35 is positioned and held by a front holding member 45 attached to the first side plate 42 and a rear holding member 46 attached to the second side plate 43, and supported between the first and second side plates 42 and 43. In FIG. 3, arrow A indicates the front of the main unit 1, which is the operator side, arrow B indicates the rear, arrow C indicates the left side, and arrow D indicates the right side of the main unit 1.

Figure 4:
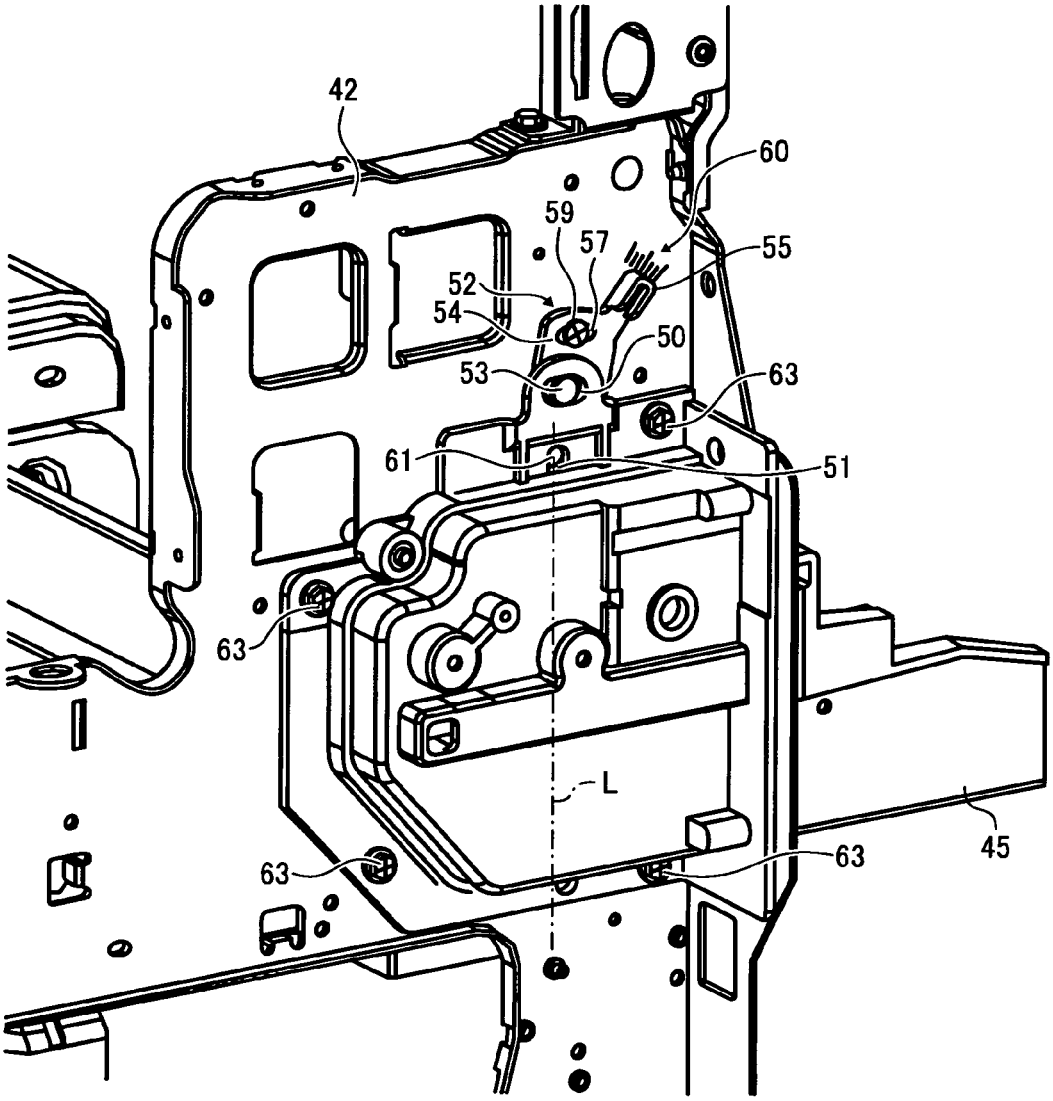
FIG. 4 is an enlarged perspective view illustrating an attaching portion of a front holding member as viewed from outside the main unit.
Figure 5:
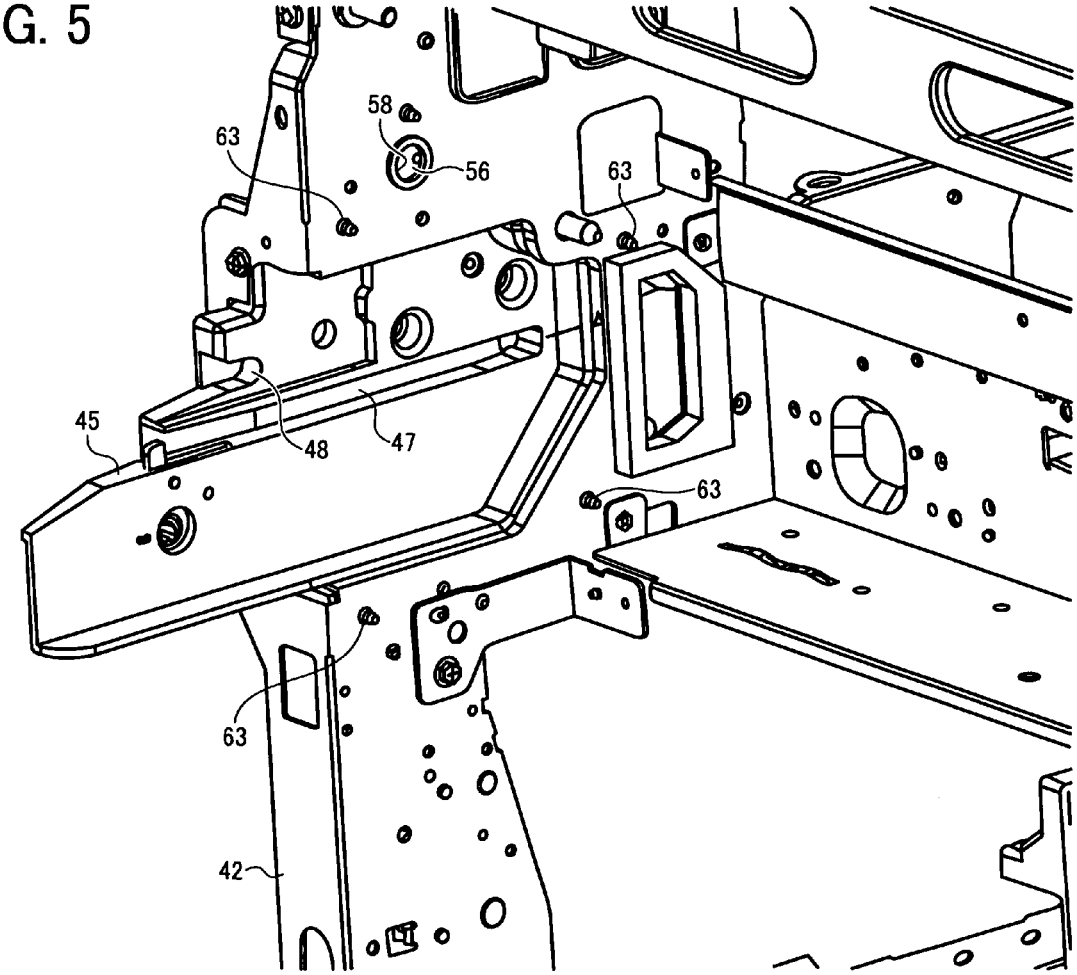
FIG. 5 is an enlarged perspective view illustrating the attaching portion of the front holding member as viewed from inside the main unit.

FIG. 4 is an enlarged perspective view illustrating the attaching portion of the front holding member 45 as viewed from outside the main unit 1. FIG. 5 is an enlarged perspective view illustrating the attaching portion of the front holding member 45 as viewed from inside the main unit 1.

As illustrated in FIG. 5, the front holding member 45 is formed with a long, straight main reference engagement slot 47 and, above it, a shorter sub-reference engagement slot 48 that are parallel to each other. As illustrated in FIG. 4, the unit holding member 45 includes a substantially circular yet elongated hole 50 in the upper part thereof. The hole 50 is elongated latitudinally in a direction parallel to the direction in which the main reference engagement slot 47 and the sub-reference engagement slot 48 extend. At upper and lower points in the front holding member 45 long guide grooves 51 or elongated holes are formed along a straight line perpendicular to the main reference engagement slot 47, the sub-reference engagement slot 48, and the hole 50, although the lower guide groove 51 is not seen in FIG. 4.

Figure 6A:
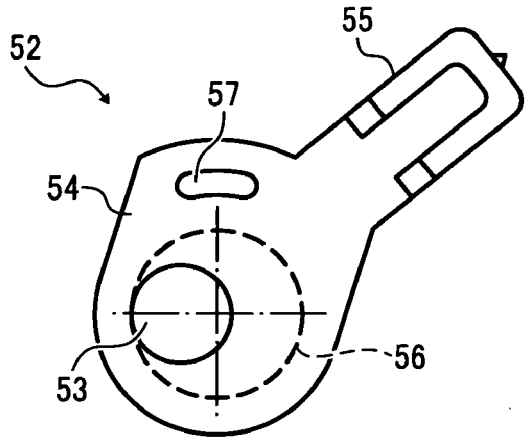
FIGS. 6A, 6B, and 6C are diagrams illustrating rotation of an eccentric cam that moves the front holding member.
Figure 6B:
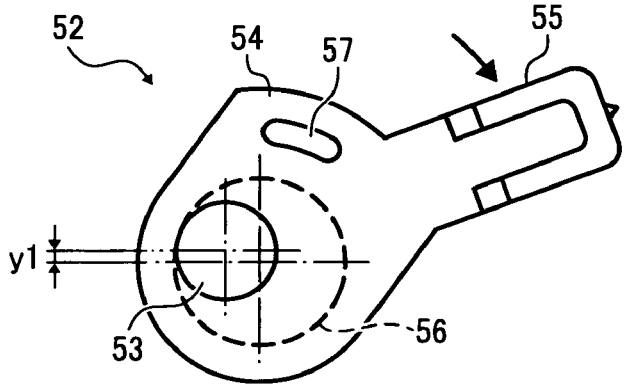
Figure 6C:
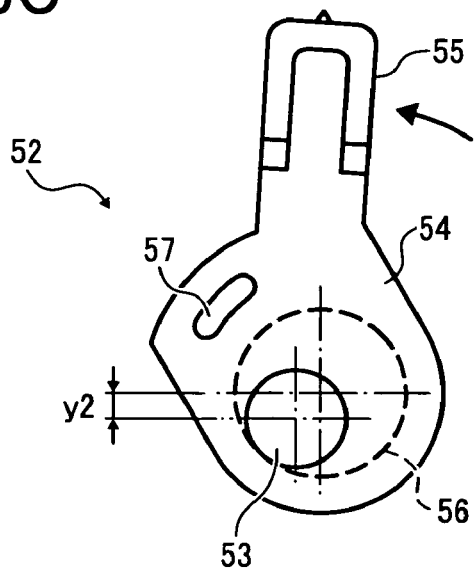

An eccentric cam 52 serving as a position adjustment member is inserted into the elongated hole 50 via an eccentric shaft portion 53. As illustrated in FIGS. 6A, 6B, and 6C, the eccentric cam 52 includes a circular disk cam 54, a lever handle 55 extending radially from the circumferential surface of the circular disk cam 54, a center shaft portion 56 of a large circle provided to one side of the circular disk cam 54, the eccentric shaft portion 53 of a small circle provided to the other side of the circular disk cam 54 in an eccentric position relative to the center shaft portion 56, and a curved slot 57 curved in an arc relative to the shaft portion 56. The eccentric shaft portion 53 has a diameter substantially equal to a height of the elongated hole 50 so as to tightly engage the hole 50 without rattling in the height direction of the hole 50.

As illustrated in FIG. 5, the center shaft portion 56 is rotatably engaged with a fitting hole 58 in the first (front) side plate 42. As illustrated in FIG. 4, the circular disk cam 54 of the eccentric cam 52 is fixed to the first side plate 42 by attaching the circular disk cam 54 to the external surface of the first side plate 42 with a fixing screw 59 through the curved slot 57. The end of the handle 55 of the eccentric cam 52 is set to indicate a scale 60 marked on the first side plate 42.

The eccentric shaft portion 53 is fitted into the elongated hole 50. The front holding member 45 is attached to the first side plate 42 by inserting two upper and lower guide protrusions 61 provided on the first side plate 42 into the respective guide grooves 51. The front holding member 45 is attached to the first side plate 42 by screwing attaching screws 63 into screw holes in the first side plate 42 through four screw elongated holes in the front holding member 45.

The two guide protrusions 61 in this example embodiment are integrally formed with the first side plate 42 by a drawing process such as burring or embossing. The guide protrusions 61 are on a vertical line L that is parallel to a vertical direction of passing the recording medium S through the fixing nip. Therefore, the two guide grooves 51 of the front holding member 45 extend in the direction of the vertical line L. The main reference engagement slot 47, the sub-reference engagement slot 48, and the elongated hole 50 extend in the direction perpendicular to the vertical line L. The four screw elongated holes in the front holding member 45 extend vertically. The vertical line L and the line connecting the center of the center shaft portion 56 and the center of the eccentric shaft portion 53 are at right angles to each other.

Therefore, when the eccentric cam 52 with the handle 55 is rotated, the front holding member 45 is moved in the direction guided by the two upper and lower guide protrusions 61, that is, the direction parallel to the (vertical) direction of the recording medium S passing through the fixing nip. The guide groove 51 has a width substantially equal to the diameter of the guide protrusion 61 so that the guide protrusion 61 engages the guide groove 51 snugly, with substantially no allowance in the width direction of the guide groove 51. Such an arrangement is preferable because it prevents rattling in the direction perpendicular to the vertical line L.

It should be noted that the guide groove 51 (or a elongated hole) and the guide protrusion 61 constitute a combination pair and can be formed on the front holding member 45 and the first side plate 42, respectively, as in the embodiment described above, or vice versa.

Figure 7:
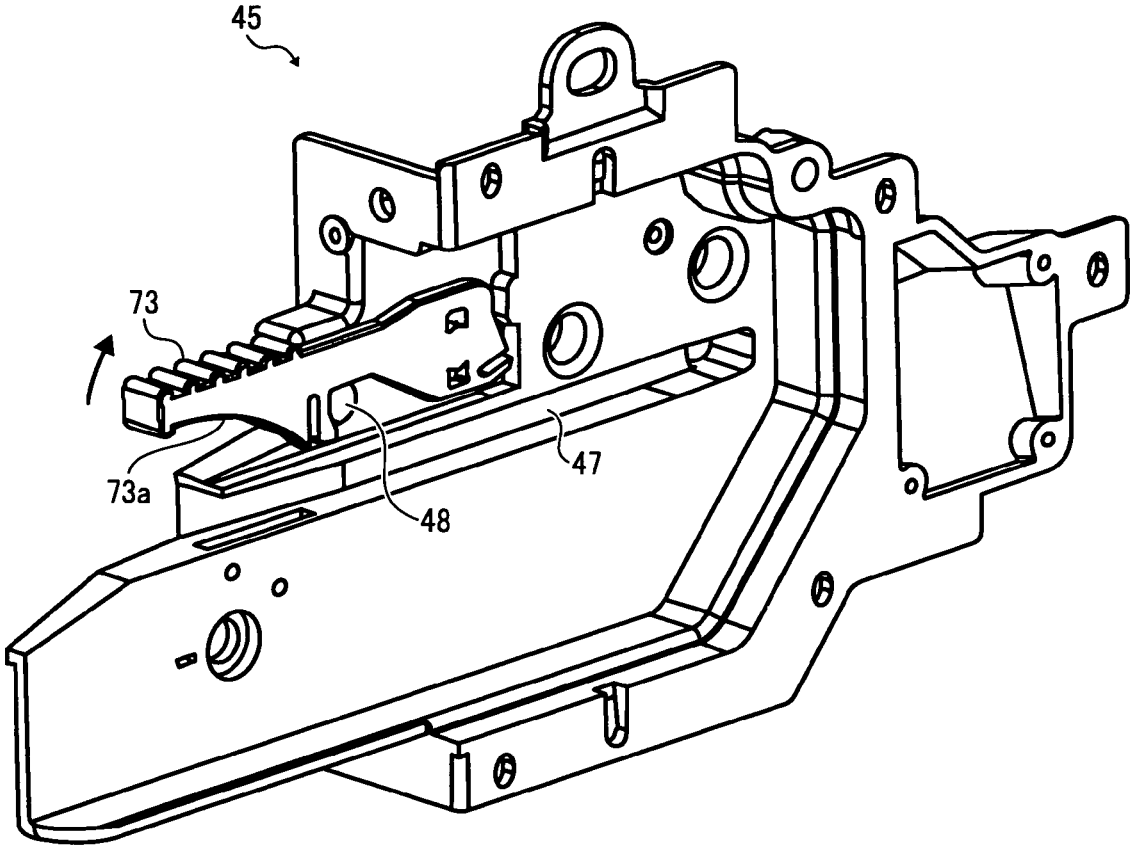
FIG. 7 is a perspective view illustrating the front holding member as viewed from inside.

FIG. 7 illustrates the front holding member 45 as viewed from inside.

In FIG. 7, a stopper lever 73 having a leading end rotating upward as indicated by an arrow about its base end is illustrated at the sub-reference engagement slot 48, although not illustrated in FIG. 5.

Figure 8:
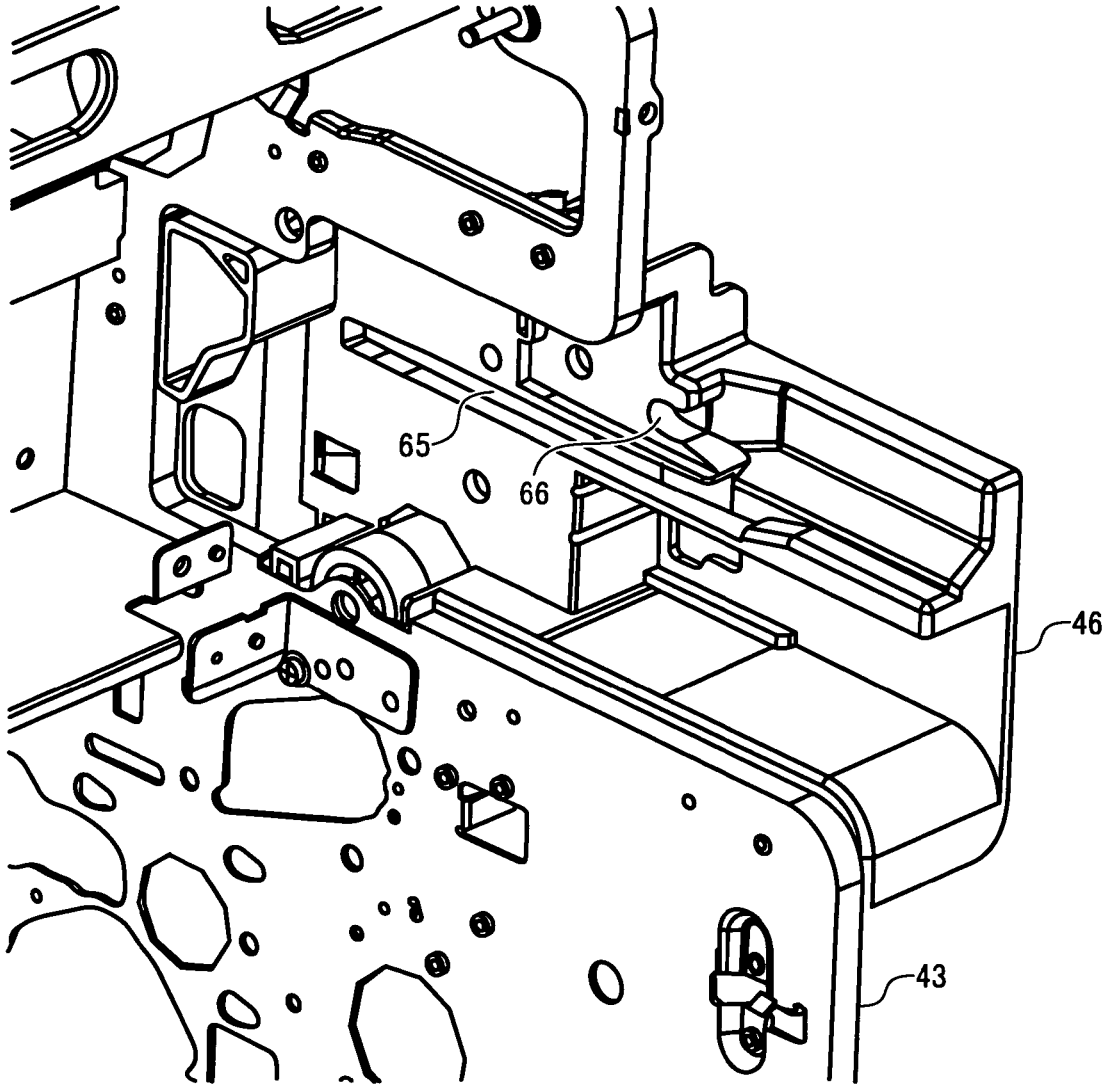
FIG. 8 is an enlarged perspective view illustrating an attaching portion of a rear holding member as viewed from inside the main unit.

FIG. 8 is an enlarged perspective view illustrating the attaching portion of the rear holding member 46 as viewed from inside the main unit 1.

As illustrated in FIG. 8, similar to the front holding member 45, the rear holding member 46 is formed with a long, straight main reference engagement slot 65 and a shorter sub-reference engagement slot 66 that are parallel to each other. The rear holding member 46 is fixed to the second side plate 43 by attaching the rear holding member 46 to the external surface of the second side plate 43 with attaching screws that are screwed into screw holes in the second side plate 43 through a plurality of screw elongated holes in the rear holding member 46. The main reference engagement slot 65 is placed opposite to the main reference engagement slot 47 in the front holding member 45 and the sub-reference engagement slot 66 is placed opposite to the sub-reference engagement slot 48 in the front holding member 45. Although not illustrated in FIG. 8, a stopper lever 73 having a leading end rotating upward about its base end is provided at the sub-reference engagement slot 66.

Figure 9:
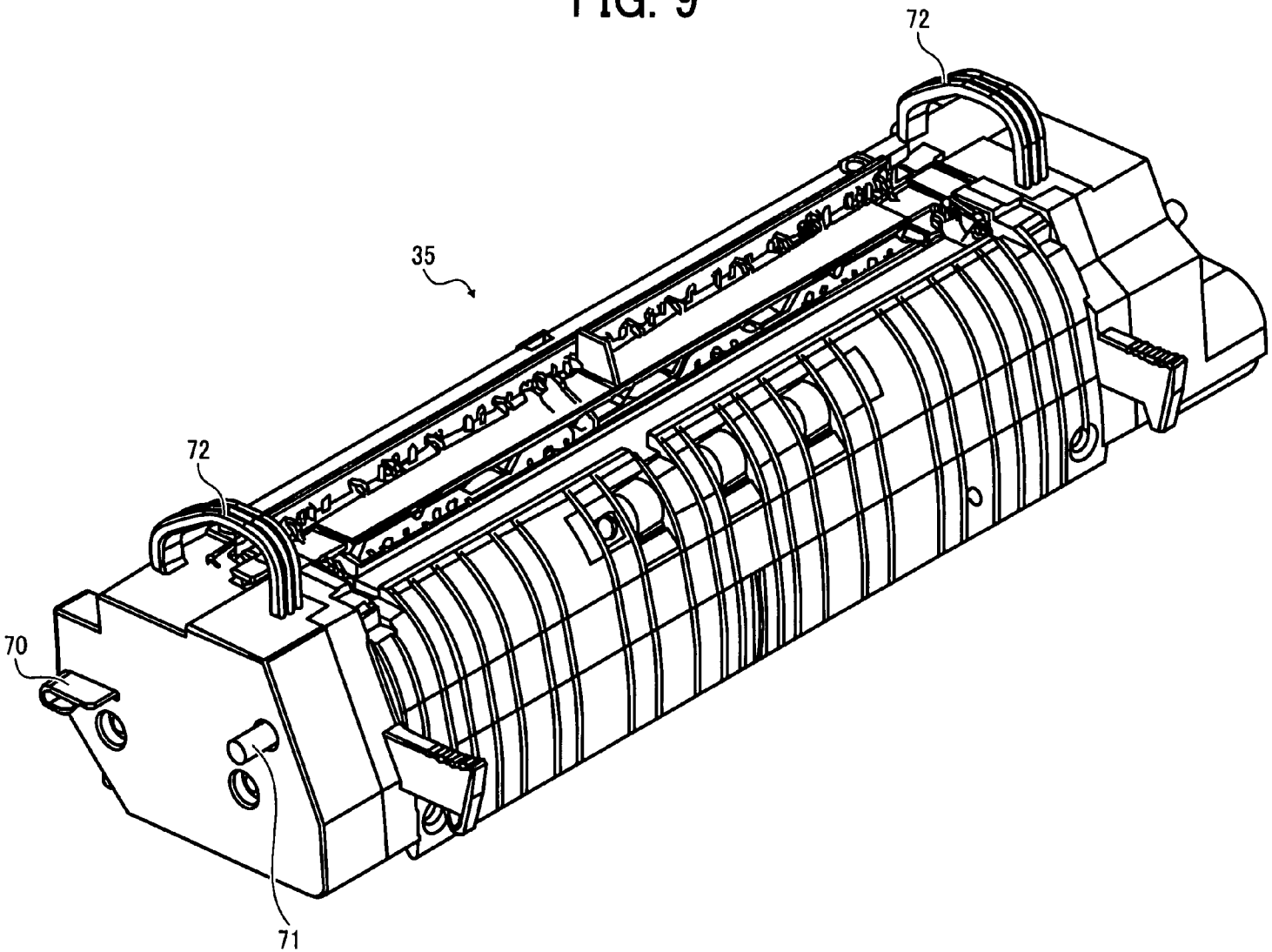
FIG. 9 is an external perspective view illustrating a fixing unit according to a first embodiment of the present invention that is included in the color copier of FIG. 1.

FIG. 9 is an external view illustrating the fixing unit 35 according to the first embodiment as viewed obliquely from upper left.

As illustrated in FIG. 9, on each of front and rear surfaces of the fixing unit 35, a main reference protrusion 70 and an axial sub-reference protrusion 71 that protrude forward on the front surface and backward on the rear surface are provided, spaced a certain distance apart. Handles 72 for handling the fixing unit 35 are located on a top surface of the fixing unit 35.

A description is now given of insertion of the fixing unit 35 in the main unit 1 of the image forming apparatus.

The fixing unit 35 is inserted between the front and rear holding members 45 and 46 from the right side of the main unit 1 by opening the side cover 9 illustrated in FIG. 1; holding the handles 72; fitting the main reference protrusions 70 to the main reference engagement slots 47 and 65 in the front and rear holding members 45 and 46; and fitting the sub-reference protrusions 71 to the sub-reference engagement slots 48 and 66 in the front and rear holding members 45 and 46.

Subsequently, the sub-reference protrusions 71 contact curved surfaces 73*a* (illustrated in FIG. 7) of the stopper levers 73 provided on the front and rear holding members 45 and 46. The stopper levers 73 are pushed open upward against gravity and the fixing unit 35 is further forced into the holding members 45 and 46. When the main reference protrusions 70 contact the ends of the main reference engagement slots 47 and 65, the stopper levers 73 return to normal positions by gravity and engage the sub-reference protrusions 71 so that the sub-reference protrusions 71 are prevented from slipping. Thus, the fixing unit 35 is installed in the main unit 1, supported by the first and second side plates 42 and 43. As noted above, the fixing unit 35 is driven by a driving force transmitted from the rear of the main unit 1.

To detach the fixing unit 35 from the main unit 1, the stopper levers 73 are manually rotated upward to release the sub-reference protrusions 71. Then, using the handles 72, the fixing unit 35 is pulled out by guiding the main reference protrusions 70 along the main reference engagement slots 47 and 65 and guiding the sub-reference protrusions 71 along the sub-reference engagement slots 48 and 66.

A description is now given of adjusting a skew or slant of the fixing unit 35.

FIG. 10 illustrates the fixing unit 35 supported by the first and second side plates 42 and 43 of the frame 40 via the front and rear holding members 45 and 46.

As illustrated in FIG. 10, a center of gravity G of the fixing unit 35 is positioned between the two upper and lower protrusions 61 provided to the first side plate 42 of the frame 40. The guide grooves 51 and the guide protrusions 61 are located on the vertical line L passing through the center of gravity G of the fixing unit 35. The position of the eccentric shaft portion 53, where the eccentric cam 52 engages the front holding member 45, is on the vertical line L. The vertical line L and a line M connecting the center of the center shaft portion 56 and the center of the eccentric shaft portion 53 are at right angles to each other.

A slant of the fixing unit 35 is adjusted by rotating the eccentric cam 52 about the center shaft portion 56 with the handle 55 and referring to the scale 60 with the fixing screw 59 and the attaching screws 63 loosened. The eccentric shaft portion 53 moves upward or downward in the direction of the vertical line L by a distance y1 or y2 as illustrated in FIG. 6B or 6C when the eccentric cam 52 illustrated in FIG. 6A is rotated clockwise or counterclockwise, thereby moving the front holding member 45 upward or downward along the vertical line L. After the adjustment, the fixing screw and then the attaching screws 63 are tightened. The accuracy with which the fixing unit 35 and the registration roller 21 are positioned parallel to each other can then be checked by forming images and checking the alignment of the images.

When the aforementioned check indicates that the fixing unit 35 and the registration roller 21 are not parallel and therefore that their relative positions need to be adjusted, the attaching screws 63 and the fixing screw 59 are again loosened and the eccentric cam 52 is rotated to move the front holding member 45. Then, the fixing screw 59 and then the attaching screws 63 are once again tightened. Images are then formed again to check the accuracy with which the fixing unit 35 and the registration roller 21 are positioned parallel to each other. This process is repeated until the fixing unit 35 and the registration roller 21 are correctly positioned parallel to each other. It should be noted that the front holding member 45 moves smoothly in the direction of the vertical line L by moving the eccentric shaft portion 53 in the direction of the vertical line L.

Figure 11:
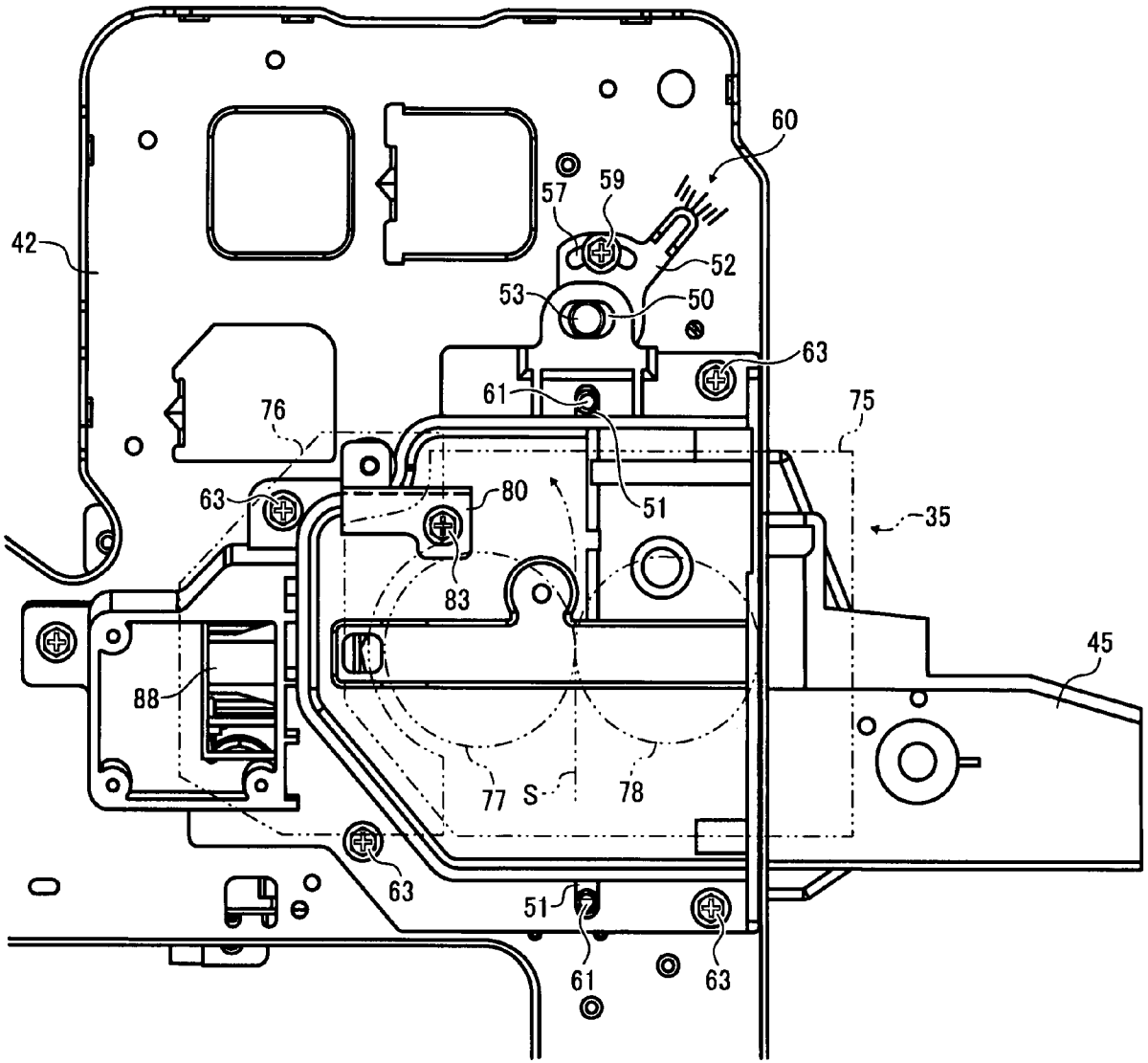
FIG. 11 is a view illustrating a fixing unit of electromagnetic induction heating type according to a second embodiment of the present invention.

FIG. 11 illustrates a fixing unit 35 of electromagnetic induction heating type according to a second embodiment of the present invention.

This fixing unit 35 includes a unit body 75 and an induction heating device 76. In the unit body 75, a fixing roller 77 serving as a fixing member and a pressure roller 78 serving as a pressure member form a fixing nip. The image on the recording medium S is fixed while the recording medium S passes through the fixing nip. On the circumferential surface of the fixing roller 77, an induction heating layer is provided. Although the fixing roller 77 is used as a fixing member in the present example, a fixing belt 38 as illustrated in FIG. 2, which has an induction heating layer on its surface, can alternatively be used as the fixing member. Also, the pressure roller 78 used as a pressure member can be replaced by a pressure pad that does not rotate. It should be noted that the same reference numerals designate corresponding components in FIGS. 10 and 11.

The center of gravity G of the fixing unit 35 of an electromagnetic induction heating type is also located between the two upper and lower protrusions 61 provided on the first side plate 42 of the frame 40. The guide grooves 51 and the guide protrusions 61 are located on the vertical line L passing through the center of gravity G of the fixing unit 35.

Figure 12:
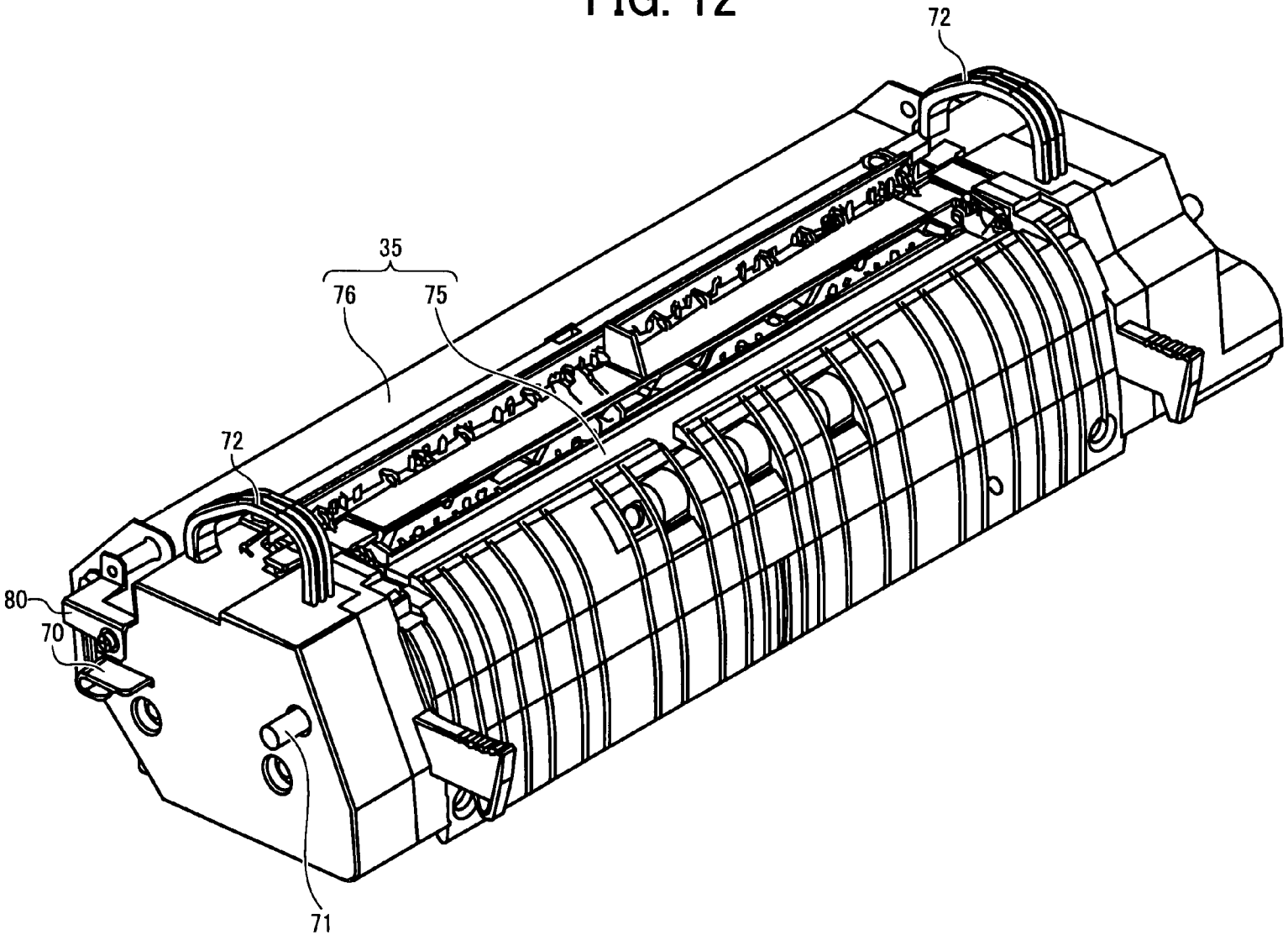
FIG. 12 is an external perspective view illustrating the fixing unit according to the second embodiment.

FIG. 12 is an external view of the fixing unit 35 of an electromagnetic induction heating type according to the second embodiment.

On each of the front and rear surfaces of the unit body 75 of the fixing unit 35, the main reference protrusions 70 and the axial sub-reference protrusions 71 that protrude forward on the front surface and backward on the rear surface, separated by a certain distance. On the top surface of the fixing unit 35, handles 72 are formed upward. By holding the handles 72, the fixing unit 35 is inserted between the front and rear holding members 45 and 46 as described above. Thus, the fixing unit 35 is installed in the main unit 1, supported by the first and second side plates 42 and 43 of the frame 40.

In the fixing unit 35, the unit body 75 and the induction heating device 76 are connected to each other using a connection member 80.

Figure 13:
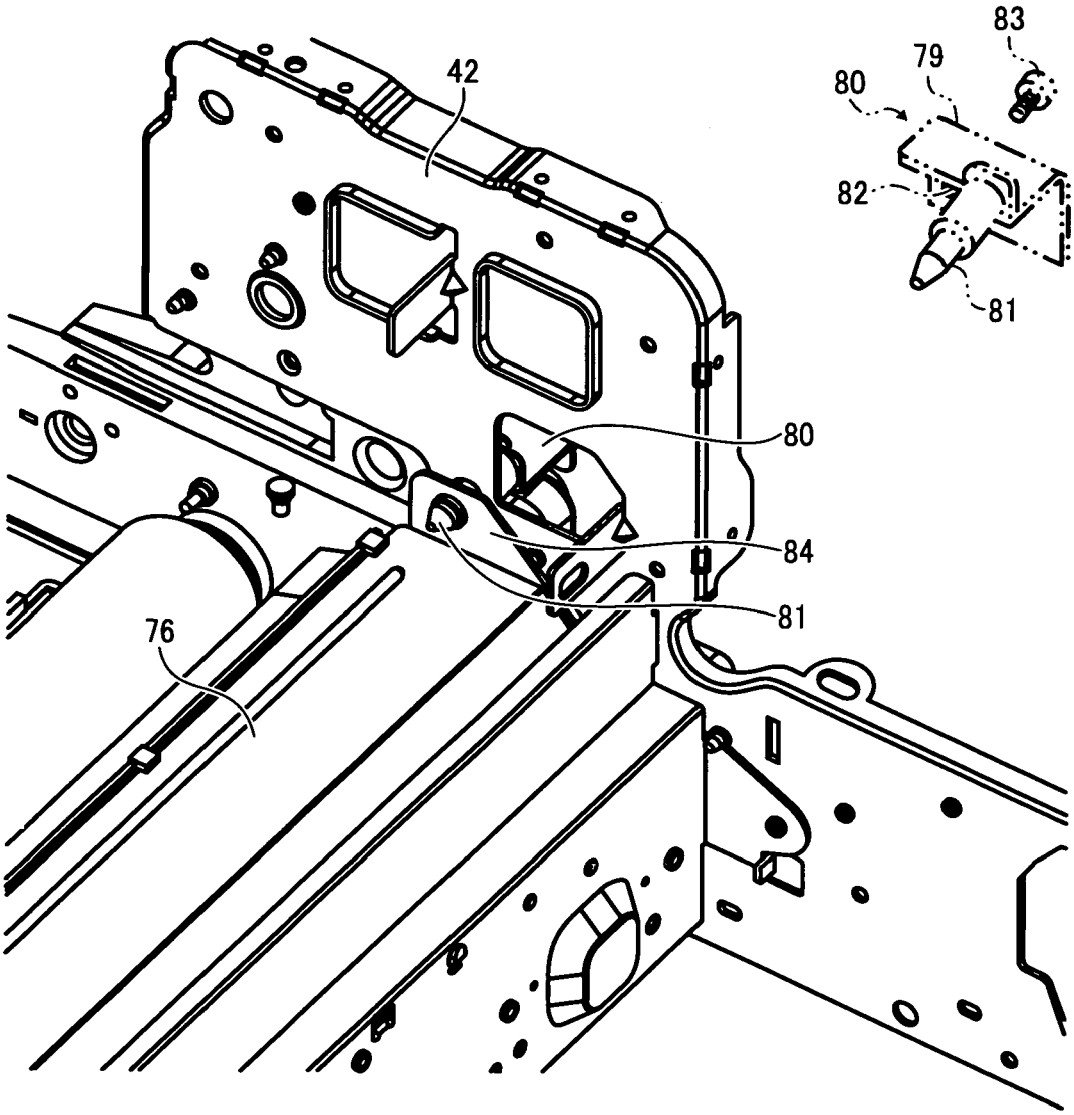
FIG. 13 is a perspective view illustrating a connection member for the fixing unit according to the second embodiment and assembly thereof.

FIG. 13 illustrates the connection member 80 and assembly thereof.

The connection member 80 includes a bent plate 79, a positioning pin 81 protruding from the bent plate 79, and a screw hole 82, and is fixed to the unit body 75 by inserting an attaching screw 83 into the screw hole 82. The leading end of the positioning pin 81 is inserted to a positioning hole 85 (illustrated in FIG. 14) in a housing 84 of the induction heating device 76 to fix the induction heating device 76 to the unit body 75 such that the induction heating device 76 is pivotable about the positioning pin 81. The induction heating device 76 is pressed against the unit body 75 by a biasing member, not shown.

Figure 14:
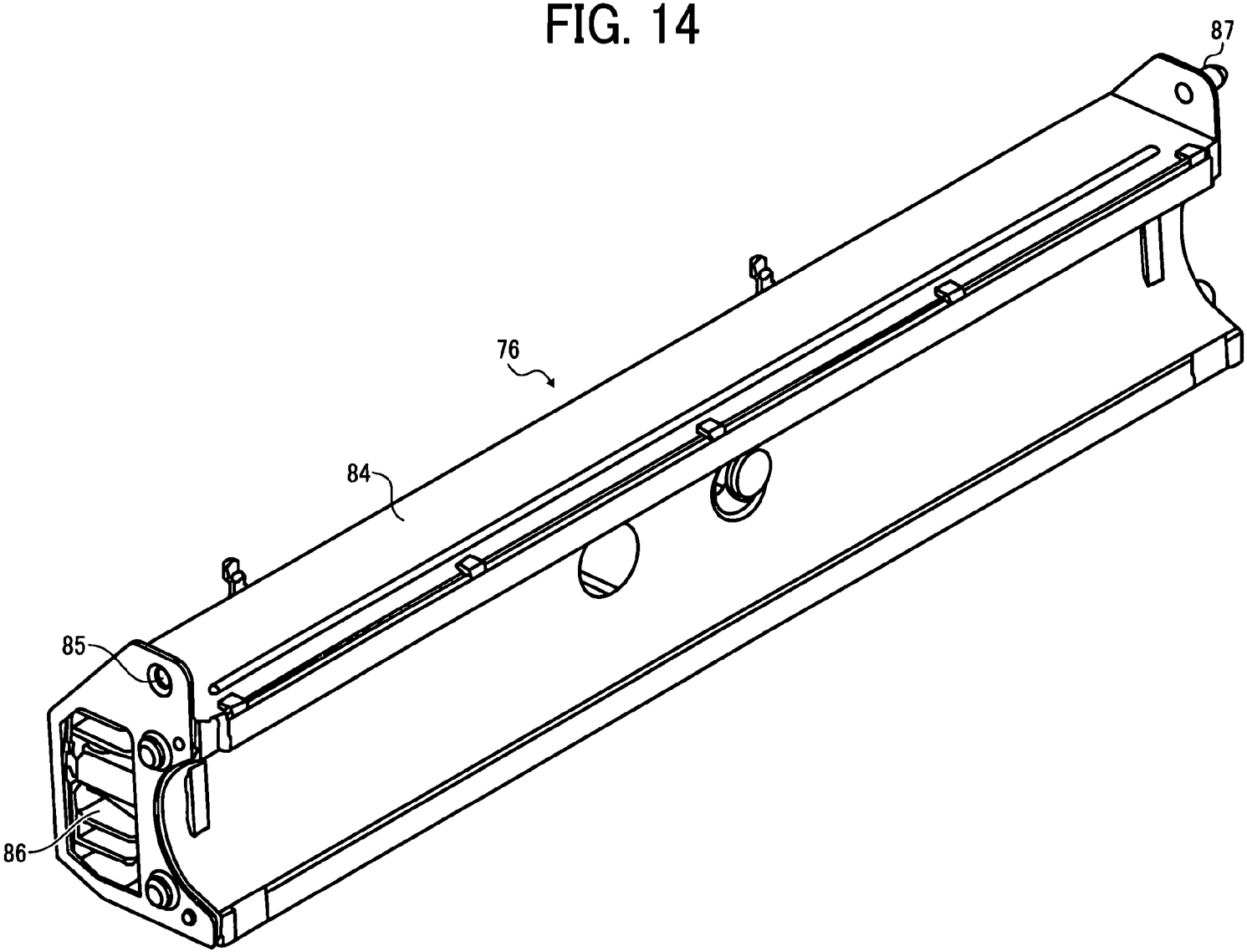
FIG. 14 is a perspective view illustrating an induction heating device included in the fixing unit according to the second embodiment.

FIG. 14 is an external view of the induction heating device 76.

The induction heating device 76 includes an induction coil 93 (refer to FIG. 19) in the housing 84. A current is applied to the induction coil 93, causing the heated induction coil 93 to generate heat in the induction heating layer of the fixing roller 77.

An air intake port 86 is provided on the front of the housing 84 and the positioning hole 85 is located above the air intake port 86. A positioning pin 87 is provided on the rear of the housing 84 at the position corresponding to the positioning hole 85. The positioning pin 87 is inserted into a positioning hole in the rear holding member 46. Thus, the induction heating device 76 is supported pivotably about the positioning pin 81 and the positioning pin 87.

Figure 15:
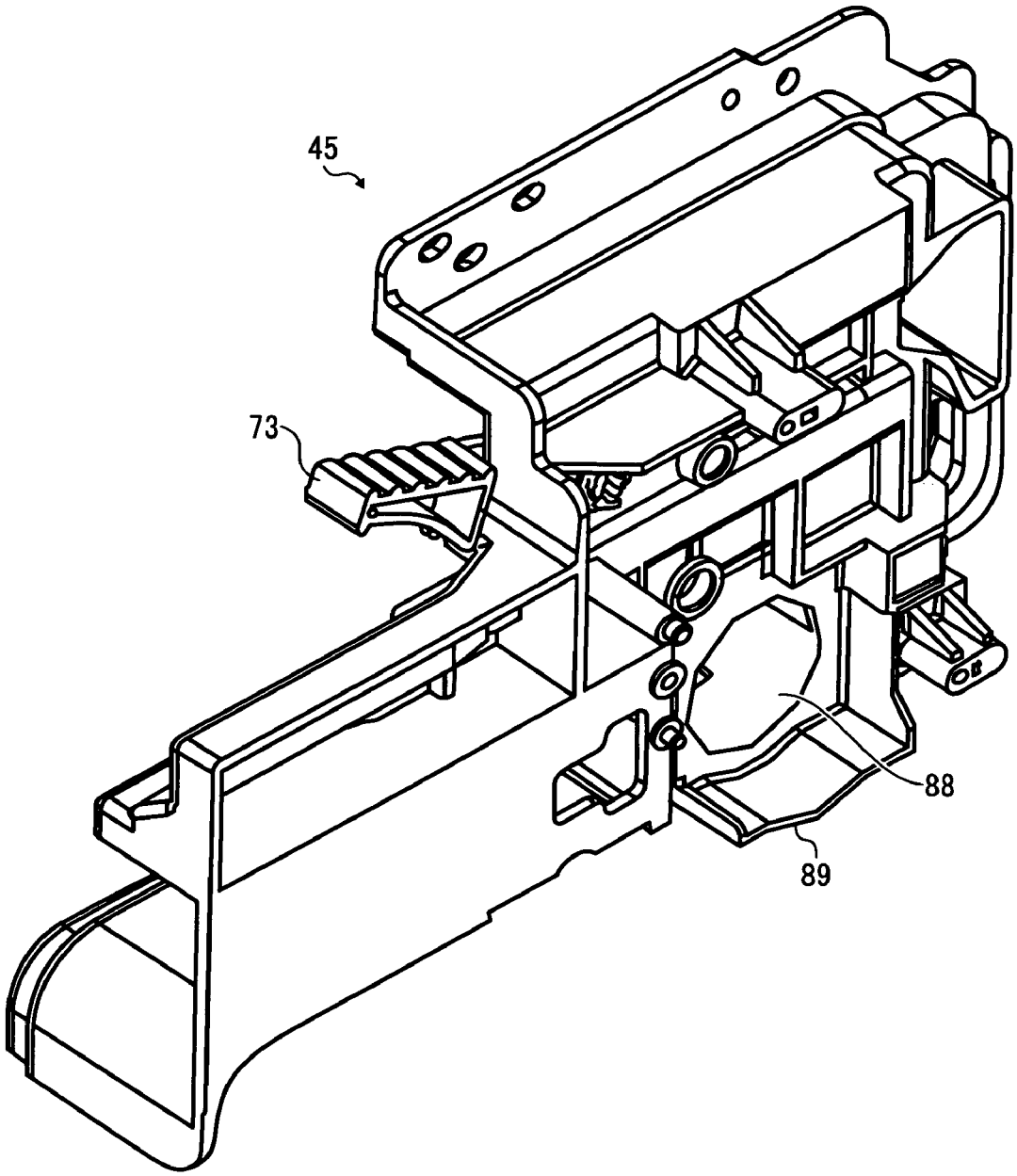
FIG. 15 is a perspective view illustrating a front holding member for the fixing unit according to the second embodiment as viewed from inside.
Figure 16:
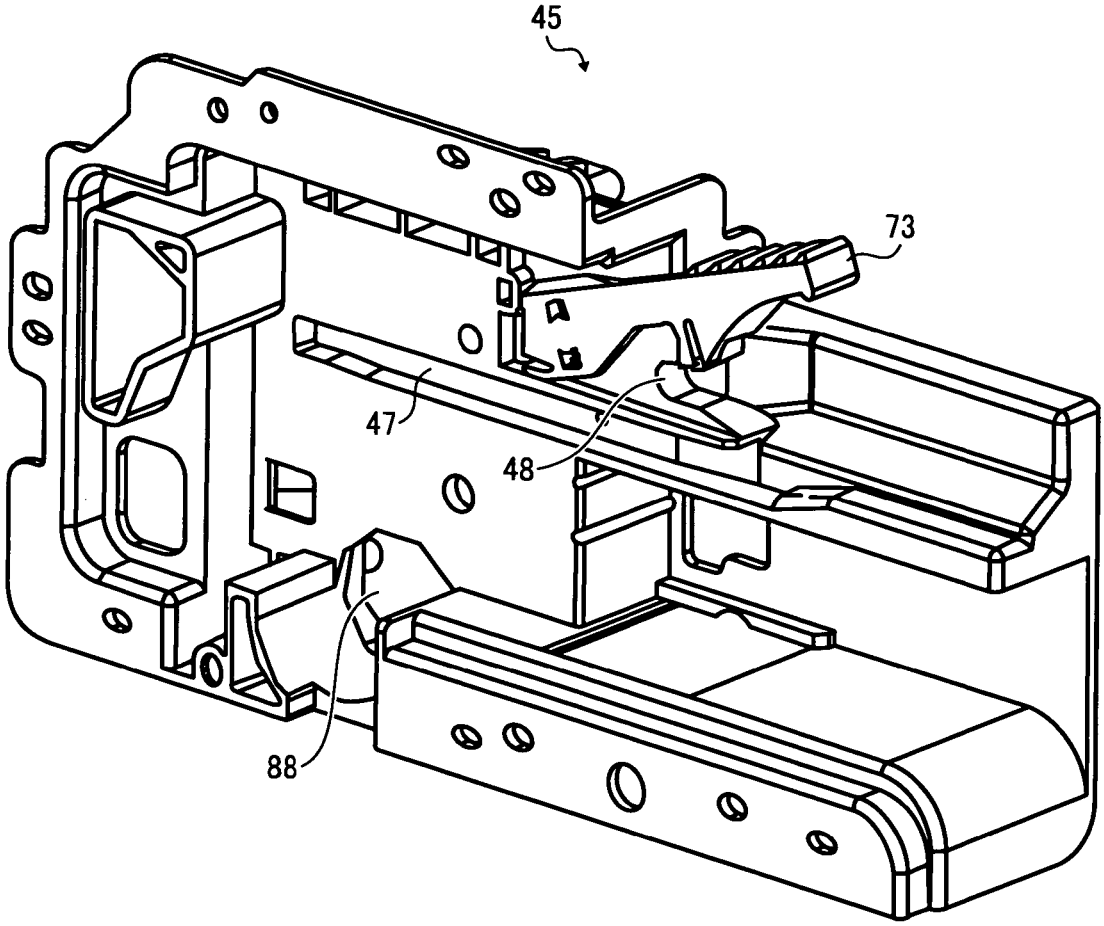
FIG. 16 is a perspective view illustrating the front holding member of FIG. 15 as viewed from outside.

FIGS. 15 and 16 illustrate inside and outside views, respectively, of the front holding member 45 for the fixing unit according to the second embodiment.

Similar to the front holding member 45 illustrated in FIGS. 4 and 5, the front holding member 45 according to the second embodiment is formed with the long, straight main reference engagement slot 47 and the short sub-reference engagement slot 48 that are parallel to each other. At the sub-reference engagement slot 48, the stopper lever 73 having a leading end that is rotatable upward against gravity about its base end as illustrated in FIG. 16 is provided.

Unlike the front holding member 45 illustrated in FIGS. 4 and 5, in the present embodiment the front holding member 45 is formed with an air intake hole 88 and a fan holder 89 having a rectangular frame around the intake hole 88.

Figure 17:
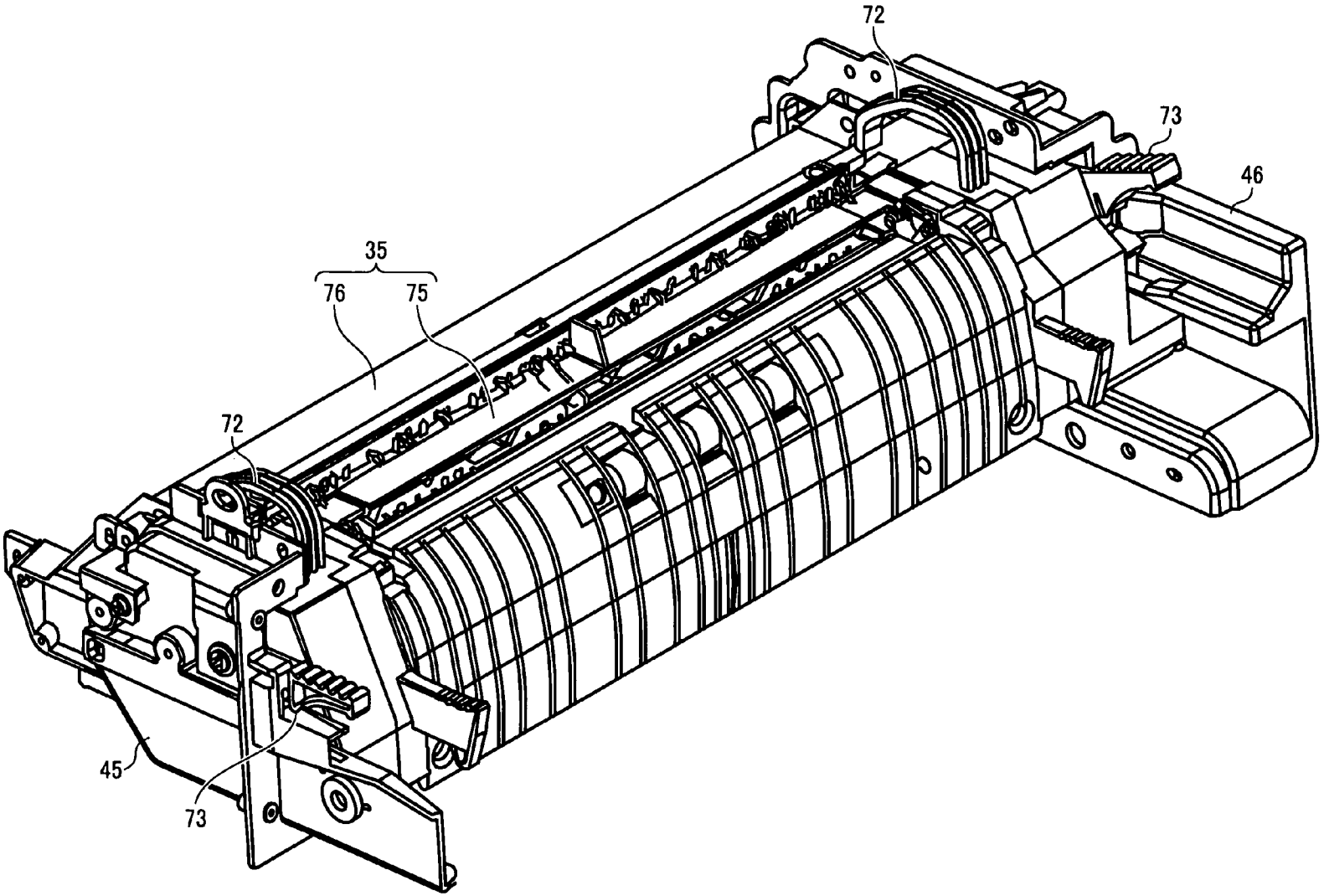
FIG. 17 is a perspective view illustrating the fixing unit according to the second embodiment mounted between the front holding member and a rear holding member.

FIG. 17 illustrates the fixing unit 35 mounted between the front holding member 45 and the rear holding member 46.

Figure 18:
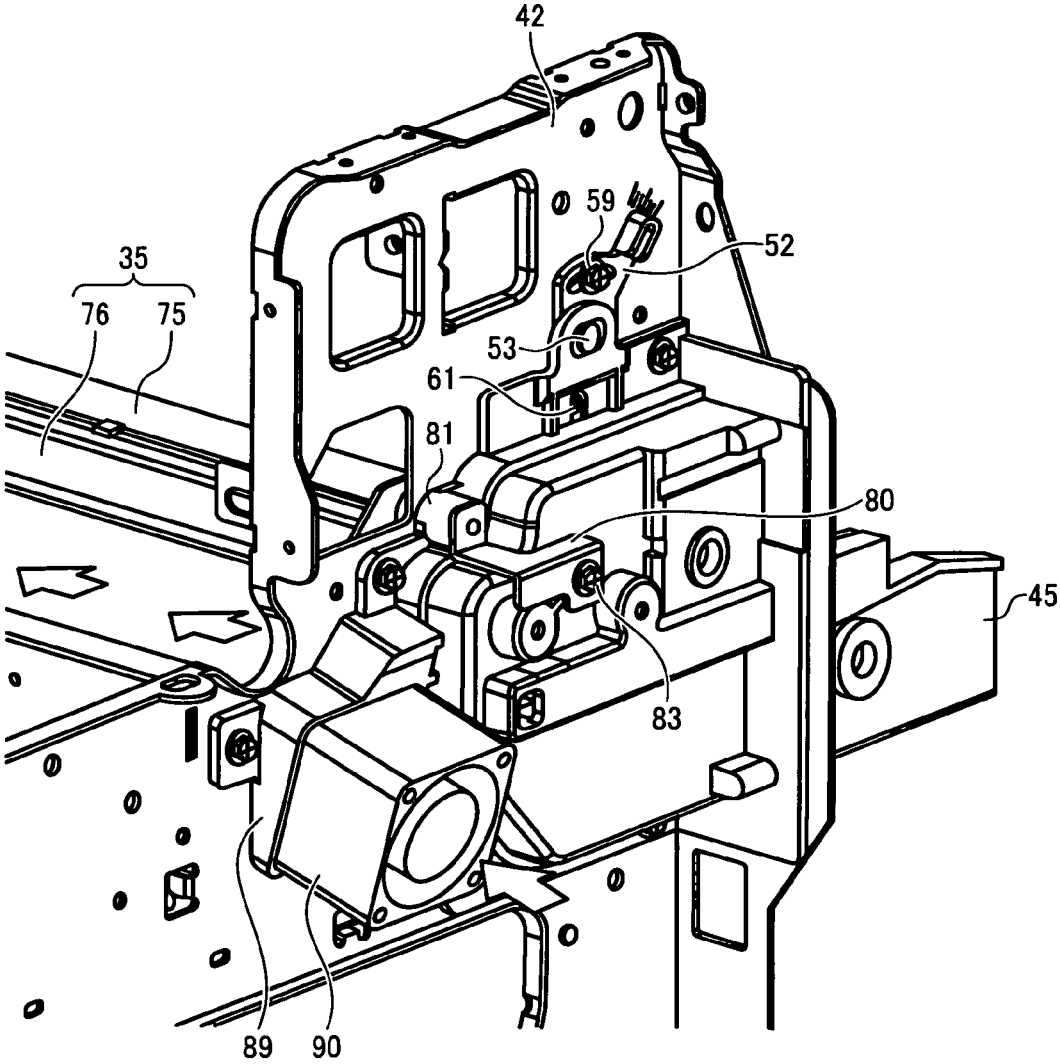
FIG. 18 is a perspective view illustrating a cooling fan mounted on a fan holder included in the front holding member.

FIG. 18 is a diagram in which a cooling fan 90 is mounted on the fan holder 89 in the front holding member 45.

Figure 19:
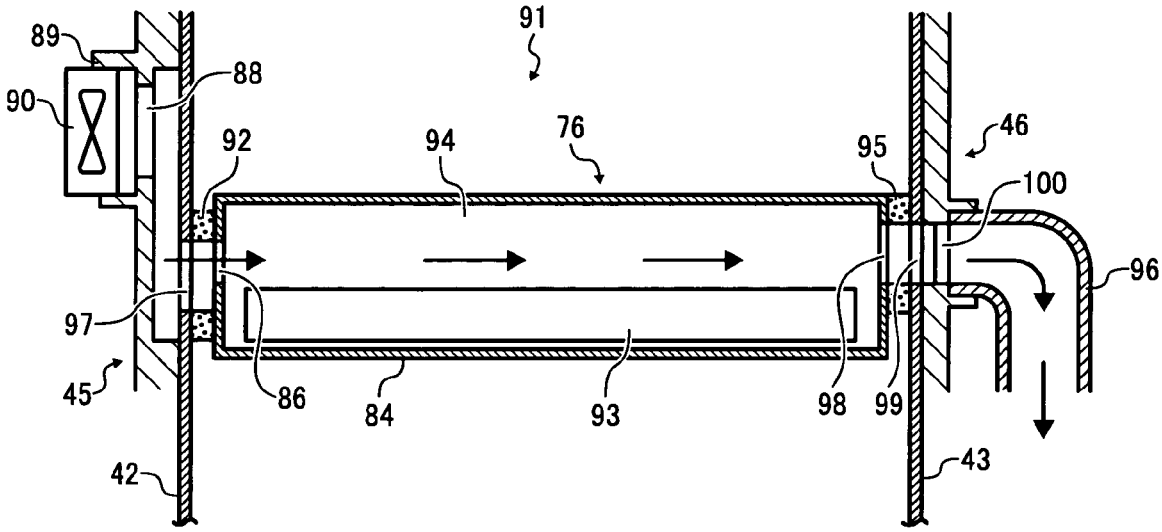
FIG. 19 is a diagram illustrating a schematic configuration of a cooling device using the cooling fan.

FIG. 19 illustrates a schematic configuration of a cooling device 91 using the cooling fan 90.

As illustrated in FIG. 19, the front holding member 45 is mounted on the front of the first (front) side plate 42 and the cooling fan 90 is mounted on the fan holder 89. The front surface of the induction heating device 76 is pressed against the internal surface of the first side plate 42 via a sealing member 92. In the induction heating device 76, the induction coil 93 is provided and an air path 94 is formed. The rear surface of the induction heating device 76 is pressed against the second (rear) side plate 43 via a sealing member 95. On the second side plate 43, the rear holding member 46 is mounted, and an exhaust duct 96 is connected thereto.

When the induction heating device 76 is in operation, the cooling fan 90 is driven to feed air to a space between the front holding member 45 and the first side plate 42 through the intake hole 88 in the front holding member 45. The air flows from an intake opening 97 in the first side plate 42 to the air path 94 through the front air intake port 86 in the housing 84 of the induction heating device 76 and cools the induction coil 93. The air heated by the induction coil 93 is discharged from the air path 94 to the exhaust duct 96 by way of a rear air discharge 98 in the housing 84, an exhaust opening 99 in the second side plate 43 and an exhaust hole 100 in the rear holding member 46. Thus, the induction coil 93 of the induction heating device 76 can maintain the thermal efficiency of the fixing roller 77.

Figure 20:
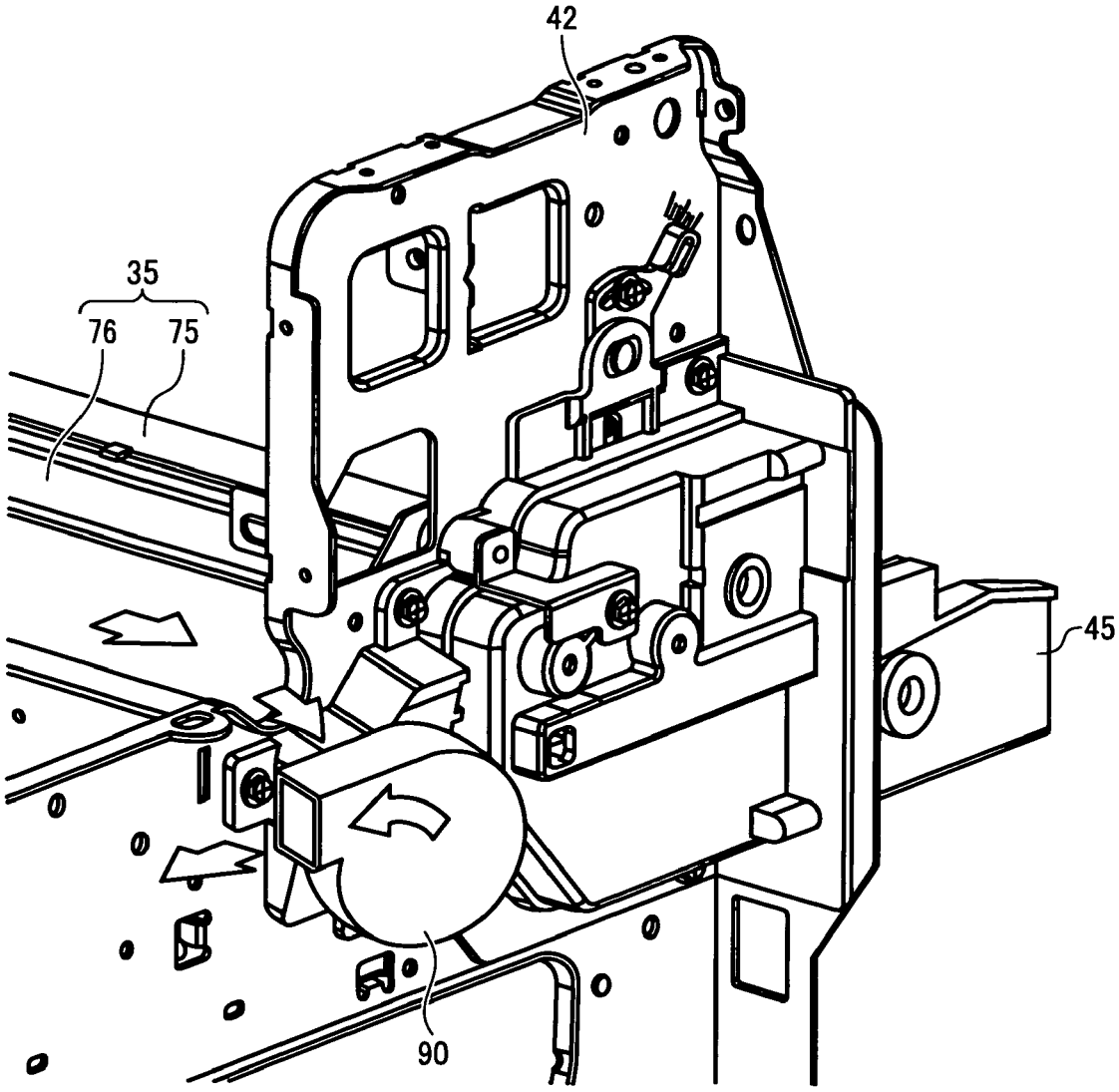
FIG. 20 is a perspective view illustrating an example embodiment in which a sirocco fan is used as the cooling fan.
Figure 21:
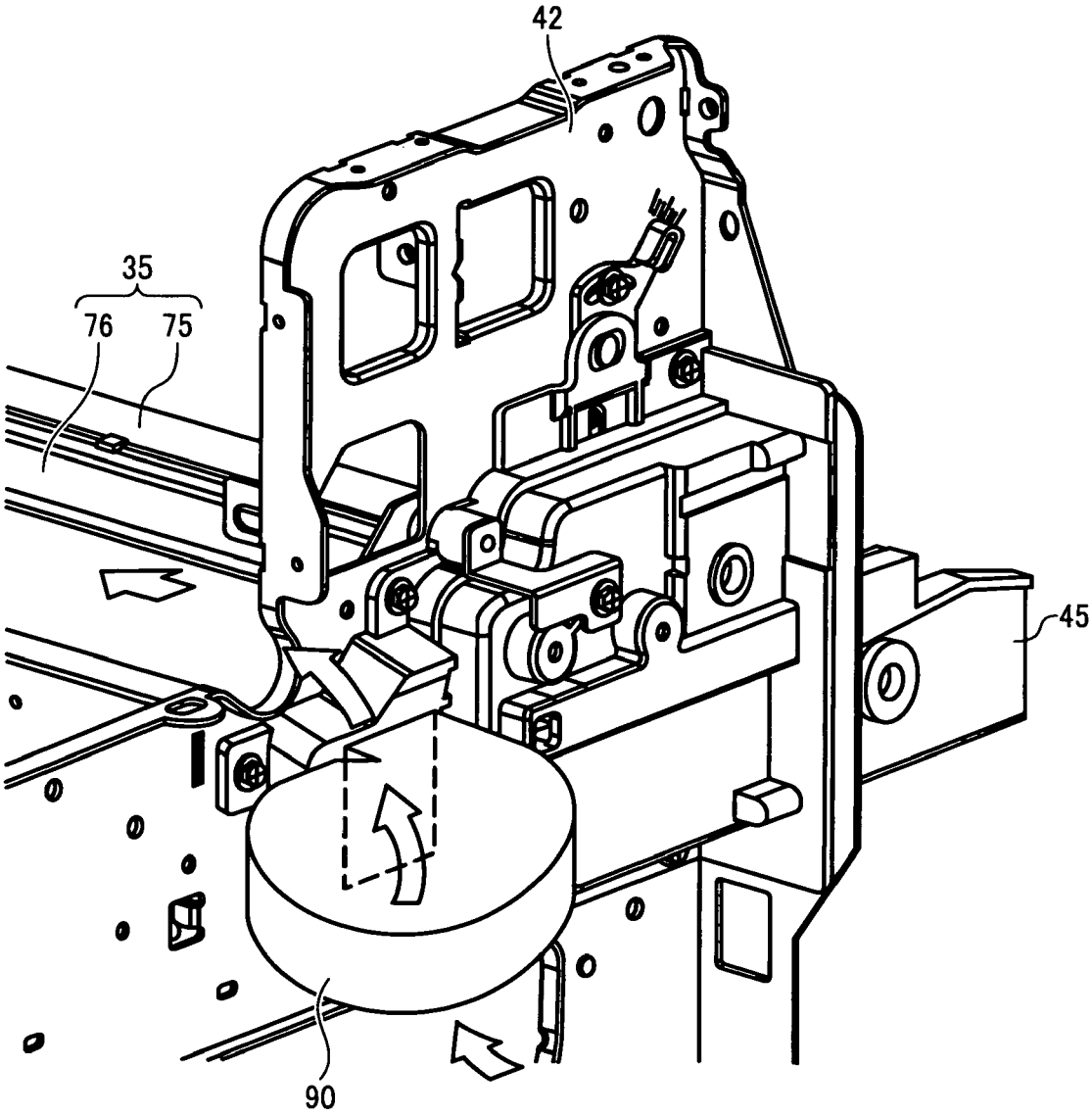
FIG. 21 is a perspective view illustrating another example embodiment in which a sirocco fan is used as the cooling fan.

It should be noted that although the cooling fan 90 in the example embodiment described above is an intake fan that draws in air to the air path 94 in the induction heating device 76, alternatively, an exhaust fan that exhausts air from the air path 94 can be used, or both an intake fan and an exhaust fan can be used. In addition, although an axial fan is used in the example embodiment, alternatively a sirocco fan as illustrated in FIG. 20 or a sirocco fan as illustrated in FIG. 21 can be used as the cooling fan 90.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. An image forming apparatus comprising:

a frame comprising a first side plate and a second side plate opposing the first side plate;

a first unit holding member engaged with the first side plate by a combination of a guide groove and a guide protrusion;

a second unit holding member attached to the second side plate;

a detachable unit located between the first side plate and the second side plate and held by the first unit holding member and the second unit holding member; and a position adjustment member configured to move the first unit holding member in a longitudinal direction of the guide groove to adjust a position of the detachable unit, the position adjustment member engaging the first unit holding member at a position vertically aligned with a center of gravity G of the detachable unit.

2. The image forming apparatus according to claim 1, wherein the position adjustment member comprises an eccentric cam, the eccentric cam comprising a rotary center shaft portion configured to rotatably engage the first side plate and an eccentric rotary shaft portion configured to rotatably engage the first unit holding member, the eccentric rotary shaft portion eccentrically positioned relative to the rotary center shaft portion.

3. The image forming apparatus according to claim 2, wherein a center of the rotary center shaft portion and a center of the eccentric rotary shaft portion are aligned at a right angle to a hypothetical vertical line L passing through the center of gravity G of the detachable unit.

4. The image forming apparatus according to claim 1, wherein the first side plate is a front side plate and the second side plate is a rear side plate relative to an operator, and a drive transmission of the detachable unit is situated on a side of the second plate.

5. The image forming apparatus according to claim 1, wherein the guide protrusion is formed on the first side plate by a drawing process and the guide groove is formed on the first unit holding member.

6. The image forming apparatus according to claim 1, wherein the guide groove and the guide protrusion are vertically aligned with the center of gravity G of the detachable unit.

7. The image forming apparatus according to claim 1, wherein the detachable unit is a fixing unit comprising a fixing member and a pressure member and configured to fix an image onto a recording medium at a fixing nip formed by the fixing member and the pressure member.

8. The image forming apparatus according to claim 7, wherein a direction of moving the first unit holding member is parallel to a direction from which the recording medium enters the fixing nip.

9. The image forming apparatus according to claim 7, wherein the fixing unit further comprises an induction heating device comprising an induction coil and the fixing member comprises an induction heating layer, and wherein a current is applied to the induction coil to generate heat in the induction heating layer.

10. The image forming apparatus according to claim 9, further comprising a cooling device configured to cool the induction heating device of the fixing unit.

11. A fixing unit support method for supporting a fixing unit in an image forming apparatus, the method comprising:

engaging a unit holding member configured to hold a fixing unit with a frame of a main unit of the image forming apparatus by a combination of a guide groove and a guide protrusion; and providing a position adjustment member comprising an eccentric cam comprising a rotary center shaft portion rotatably engaging the frame and an eccentric rotary shaft portion eccentrically positioned relative to the rotary center shaft portion and rotatably engaging the unit holding member at a position vertically aligned with a center of gravity G of the fixing unit.

12. A fixing unit position adjustment method for an image forming apparatus, the image forming apparatus comprising:

a frame;

a unit holding member engaged with the frame by a combination of a guide groove and a guide protrusion and configured to hold a fixing unit; and a position adjustment member comprising an eccentric cam comprising a rotary center shaft portion rotatably engaging the frame and an eccentric rotary shaft portion eccentrically positioned relative to the rotary center shaft portion and rotatably engaging the unit holding member at a position vertically aligned with a center of gravity G of the fixing unit;

the fixing unit position adjustment method for the image forming apparatus comprising:

rotating the position adjustment member; and moving the unit holding member in the longitudinal direction of the guide groove to adjust a position of the fixing unit.

* * * * *